US007421219B2

(12) United States Patent
Matsuura et al.

(10) Patent No.: US 7,421,219 B2
(45) Date of Patent: Sep. 2, 2008

(54) IMAGE FORMING APPARATUS

(75) Inventors: Taisuke Matsuura, Toride (JP); Kota Arimoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 255 days.

(21) Appl. No.: 11/470,426

(22) Filed: Sep. 6, 2006

(65) Prior Publication Data

US 2007/0059001 A1 Mar. 15, 2007

(30) Foreign Application Priority Data

Sep. 13, 2005 (JP) ..... 2005-265871
Sep. 13, 2005 (JP) ..... 2005-265874

(51) Int. Cl.
*G03G 15/00* (2006.01)
*G03G 15/20* (2006.01)

(52) U.S. Cl. ..... 399/45; 399/68; 399/334

(58) Field of Classification Search ..... 219/216; 399/43, 45, 67, 68, 69, 322, 324, 334
See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 5,210,579 | A | 5/1993 | Setoriyama et al. | 355/285 |
| 5,525,775 | A | 6/1996 | Setoriyama et al. | 219/216 |
| 5,561,512 | A * | 10/1996 | Fukano et al. | 399/69 |
| 6,580,883 | B2 * | 6/2003 | Suzumi | 399/69 |
| 7,359,654 | B2 * | 4/2008 | Iwasaki | 399/69 |

FOREIGN PATENT DOCUMENTS

| | | |
|---|---|---|
| JP | 60-136779 | 7/1985 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 2003-076209 | 3/2003 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus, wherein a heating member heats a toner image formed on a sheet by an image forming portion, including: a first detector detecting a temperature of a first area of a contact area, which is contactable with the sheet, of the heating member, when a set width of the sheet is a predetermined width; a controller for controlling the heating member based on the output of the first detector; a second detector detecting a temperature of a second area outside of the first area; a cooler cooling the second area based on the output of the second detector; a third detector detecting a temperature of a third area on an end side in the width direction within the contact area; and a stopper stopping the image heating operation based on the output of the third detector.

7 Claims, 25 Drawing Sheets

ELECTRIC POWER VALUE = (DETECTED TEMPERATURE - SET TEMPERATURE) × A

IMAGE FORMING APPARATUS

BACKGROUND OF THE INVENTION

1. Field of the Invention

The present invention relates to an image forming apparatus for forming a toner image on a recording material. The above-mentioned image forming apparatus includes, for instance, a copying machine, a printer, a FAX (facsimile machine), and a multifunction apparatus equipped with those functions in plurality.

2. Description of the Related Art

Conventionally, the above-mentioned image forming apparatus generally employs as a fixing system for fixing an unfixed toner image on a recording material a thermal fixing system in view of safety and an excellent fixability. In the thermal fixing system, the unfixed toner images of the recording material is heated to be melted so as to be fixed on the recording material.

Also, in recent years, a heating apparatus of a belt heating type has been practically utilized in view of a quick start and energy savings. In other words, a pressure contact nip portion (hereinafter, referred to as "fixing nip portion") is formed by sandwiching a heat resistance resin belt (hereinafter, referred as "fixing belt") as an image heating member between a heating member, for example, a ceramics heater, and a pressure roller serving as a pressure member. Then, a recording material which carries an unfixed toner image formed thereon is introduced between the fixing belt and the pressure roller of the fixing nip portion, and the recording material is sandwiched and transported in combination with the fixing belt. As a result, the unfixed toner image is fixed on a surface of a recording material by being applied by pressure of the fixing nip portion while the heat of the ceramics heater is applied thereto via the fixing belt.

The heating apparatus of belt heating type can be brought into a heatable condition even if an operation of energizing the heater is commenced after an image forming apparatus has received a print signal until the recording material reaches the heating apparatus, while the energizing operation to the heater during standby status is not required. As a consequence, the above-mentioned heating apparatus of belt heating type may constitute such a heating fixing apparatus having a superior characteristic without wasting energy in view of energy savings.

Furthermore, another fixing system has been proposed in which a pressure member is arranged in such a manner that the pressure member is located via a belt opposite to a fixing roller.

Even in any of the cases where any of the above-mentioned fixing system is employed, when a recording material is subjected to fixing within a fixing area, a sheet passing area surface of the heating roller has a substantially uniform temperature distribution.

However, in such a case where small size recording materials having widths smaller than a width of a maximum width size recording material which can be passed through an apparatus are continuously subjected to fixation in a fixing area, a temperature of a non-sheet passing area surface of the heating roller is excessively increased. The excessive increase in temperature is caused by the following reason. That is, when the small size recording materials are continuously passed, heat is partially stored in the non-sheet passing area where the recording materials are not passed, because the heat cannot be deprived by the recording materials.

The phenomenon is referred to as an "end portion increased temperature" of the fixing apparatus, or a "non-sheet passing portion increased temperature" thereof. When the edge portion increased temperature of the fixing apparatus becomes high, the high temperature exceeds temperature rise limitations as to fixing member structural components and a pressure roller, which may cause these components to be damaged.

In order to prevent such a non-sheet passing portion increased temperature, conventionally, when small size recording materials are passed, a so-called "throughput down control operation" is carried out by which because a rotating speed of a fixing operation is reduced, a temperature rise of the non-sheet passing portion is suppressed. However, the throughput down control operation eventually lowers the productivity.

In order to prevent the reduction of the productivity, as described in Japanese Patent Application Laid-Open No. S60-136779 and Japanese Patent Application Laid-Open No. 2003-076209, the following structures are known. That is, while an air blowing fan is provided in a fixing apparatus, the air blowing fan blows wind to a heat roller and a pressure roller of a non-sheet passing portion. Thus, while the temperature rise of the non-sheet passing portion may be suppressed, both the suppression of the non-sheet passing portion increased temperature and the superior productivity may be achieved.

In the apparatus described in Japanese Patent Application Laid-Open No. S60-136779, a cooling fan arranged on the fixing apparatus blows cooling wind to the non-sheet passing portion side. Also, while such an element for detecting a temperature of a fixing area when a small size paper is passed is provided, an ON/OFF control operation for the air blowing fan is carried out based on a signal value of the temperature detecting element.

In the apparatus described in Japanese Patent Application Laid-Open No. 2003-076209, in such a case where the cooling fan blows the cooling wind to the non-sheet passing area side, because a length of an air blowing port in the width direction is adjusted based on a width of a recording material to be employed, the above-mentioned non-sheet passing portion increased temperature may be avoided even with respect to papers having different sizes from each other.

In the apparatus described in Japanese Patent Application Laid-Open No. S60-136779 and Japanese Patent Application Laid-Open No. 2003-076209, in order to improve lowering of the productivity caused by the throughput down control operation, the air blowing fans are employed. As a result, when the small size recording materials are continuously passed while the air blowing fans are operated, the fixing operations are carried out at the normal fixing speeds.

However, when a cooling area of a fixing member by an air blowing fan is different from a width of such a recording material which is actually passed, for example, in such a case where a B5R width is passed when a non-sheet passing portion of an A4R width is cooled, a surface of the fixing member outside the A4R edge is cooled by the air blowing fan. Nevertheless, such an area from the B5R edge to the A4R edge becomes the non-sheet passing portion, because the actual sheet passing portion is the B5R width. As a result, although the temperature as to the non-sheet passing portion is increased, the portion is not cooled by the air blowing fan. But also, because the air blowing fan is operated, there is no possibility that the throughput down control operation is carried out. As a consequence, the temperature as to the above-mentioned area of the fixing member surface is excessively increased. Therefore, there is a risk that the fixing apparatus may be finally destroyed.

Among current copying machines, there are many such copying machines that detecting members for automatically recognizing sizes of recording materials are not equipped on main bodies thereof due to cost down purposes, namely, users set these sizes of recording materials which are used in these copying machines. In other words, the above-mentioned event may occur in the case where width sizes of recording material which are set/instructed by users are different from width sizes of recording materials which are actually used.

In such an apparatus equipped with an arrangement capable of preventing a non-sheet passing portion increased temperature by employing a cooling means such as an air blowing fan, in which a detecting member for automatically recognizing a recording material size is not provided, a safety characteristic capable of preventing destruction of the apparatus must be secured, while the apparatus destruction is caused by that a set size of the recording material is not coincident with an actual sheet passing size.

In the apparatus disclosed in Japanese Patent Application Laid-Open No. S60-136779, the ON/OFF operations of the air blowing fan are carried out based on the signal value of the element which detects the temperature of the fixing area, so the cooling operation for the fixing apparatus is carried out by the air blowing fan. However, the above-mentioned temperature detecting element is employed in the ON/OFF operations for the air blowing fan when a recording material having such a size that the air blowing fan is operated is passed, whereas the temperature detecting element is not so arranged in order that the temperature of the temperature raised portion can be detected when the air blowing area is not coincident with the sheet passing area. As a result, such a safety characteristic of the fixing apparatus when the user erroneously sets the recording material cannot be secured.

Also, as explained above, in such a case where the recording material is erroneously set, because the actual image size is different from the recording material size, there are some possibilities that such images of which edge portions are dropped out are discharged, and therefore, it is desirable to immediately stop printing operations.

Also, as described above, even when the air blowing area is not coincident with the sheet passing size, it is desirable for users that the image forming operation be accomplished without stopping the printing operation.

Further, in the apparatus described in Japanese Patent Application Laid-Open No. 2003-076209, the following technical idea is disclosed. That is, the different recording material sizes can be accepted by the cooling operation by the air blowing fan and by the opening width adjusting mechanism. However, the employment of such an opening width adjusting mechanism may cause a cost-up problem, and a cumbersome and expensive apparatus is necessarily required in order to accept a plurality of recording material sizes up to a minimum width paper such as a postcard.

Under such a circumstance, many apparatus are not equipped with the above-mentioned opening width adjusting mechanism. Normally, these apparatus cannot accept postcard sizes of which use frequencies are low, but are equipped with a fixed opening, which is fitted to such a recording material size of which use frequency is the highest value.

Even such the apparatus equipped with fixed opening widths has a similar problem to that of the fixing apparatus equipped with the opening width adjusting mechanism, and therefore, the safety characteristic when the recording material is erroneously set must be secured, and also, the image forming operation must be accomplished.

SUMMARY OF THE INVENTION

An object of the present invention is to provide an image forming apparatus capable of properly performing an image forming operation even in such a case where a width of a recording material is erroneously set.

Another object of the present invention is to provide an image forming apparatus capable of properly performing an image heating process operation even with respect to such a recording material having a narrow width which cannot be properly accepted by a cooling means.

The present invention has an object to provide an image forming apparatus, including:

image forming means for forming a toner image on a recording material;

an image heating member, which heats the toner image formed on the recording material in a nip portion;

heating means for heating the image heating member;

first detecting means for detecting a temperature of a first area, which can be brought into contact with a recording material, of the image heating member, when a set width of the recording material is a predetermined width;

control means for controlling an electric power supply to the heating means in accordance with output of the first detecting means;

second detecting means for detecting a temperature of a second area outside of the first area of the image heating member in a width direction, when the set width of the recording material is the predetermined width;

cooling means for cooling the second area of the image heating member in accordance with output of the second detecting means;

third detecting means for detecting a temperature of a third area on an end side in the width direction within an area, which can be brought into contact with the recording material, of the image heating member, when the set width of the recording material is the predetermined width; and stopping means for stopping the image heating operation in accordance with output of the third detecting means.

Also, the present invention has an object to provide an image forming apparatus, including:

image forming means for forming a toner image on a recording material;

an image heating member, which heats the toner image formed on the recording material in a nip portion;

heating means for heating the image heating member;

first detecting means for detecting a temperature of a first area, which can be brought into contact with a recording material, of the image heating member, when a set width of the recording material is a predetermined width;

control means for controlling an electric power supply to the heating means in accordance with output of the first detecting means;

second detecting means for detecting a temperature of a second area outside of the first area of the image heating member in a width direction when the set width of the recording material is the predetermined width;

cooling means for cooling the second area of the image heating member in accordance with output of the second detecting means;

third detecting means for detecting a temperature of a third area on an end side in the width direction within an area, which can be brought into contact with the recording material, of the image heating member, when the set width of the recording material is the predetermined width; and reducing means for reducing a number of recording materials, which pass through the nip portion per unit time in accordance with output of the third detecting means.

Further, the present invention has an object to provide an image forming apparatus, comprising:

image forming means for forming a toner image on a recording material;

an image heating member, which heats the toner image formed on the recording material in a nip portion;

detecting means for detecting a temperature of a first area outside of a second area, which can be brought into contact with the recording material, of the image heating member in a width direction, when a width of the recording material is a predetermined width;

cooling means for cooling the first area of the image heating member in accordance with output of the detecting means; and reducing means for reducing a number of recording materials, which pass through the nip portion per unit time, without performing the cooling operation of the cooling means, when the width of the recording materials is smaller than the predetermined width.

Further features of the present invention will become apparent from the following description of exemplary embodiments with reference to the attached drawings.

DETAILED DESCRIPTION OF THE EMBODIMENTS

The invention will hereinafter be described in detail with reference to the embodiments. Incidentally, though the embodiments are examples of the best mode of the invention, the invention should not be limited to only the structures described in the embodiments. That is, the structures described in the embodiments can be replaced with the other known structures within the scope of the invention.

Embodiment 1

(1) Image Forming Portion

Figure 4:
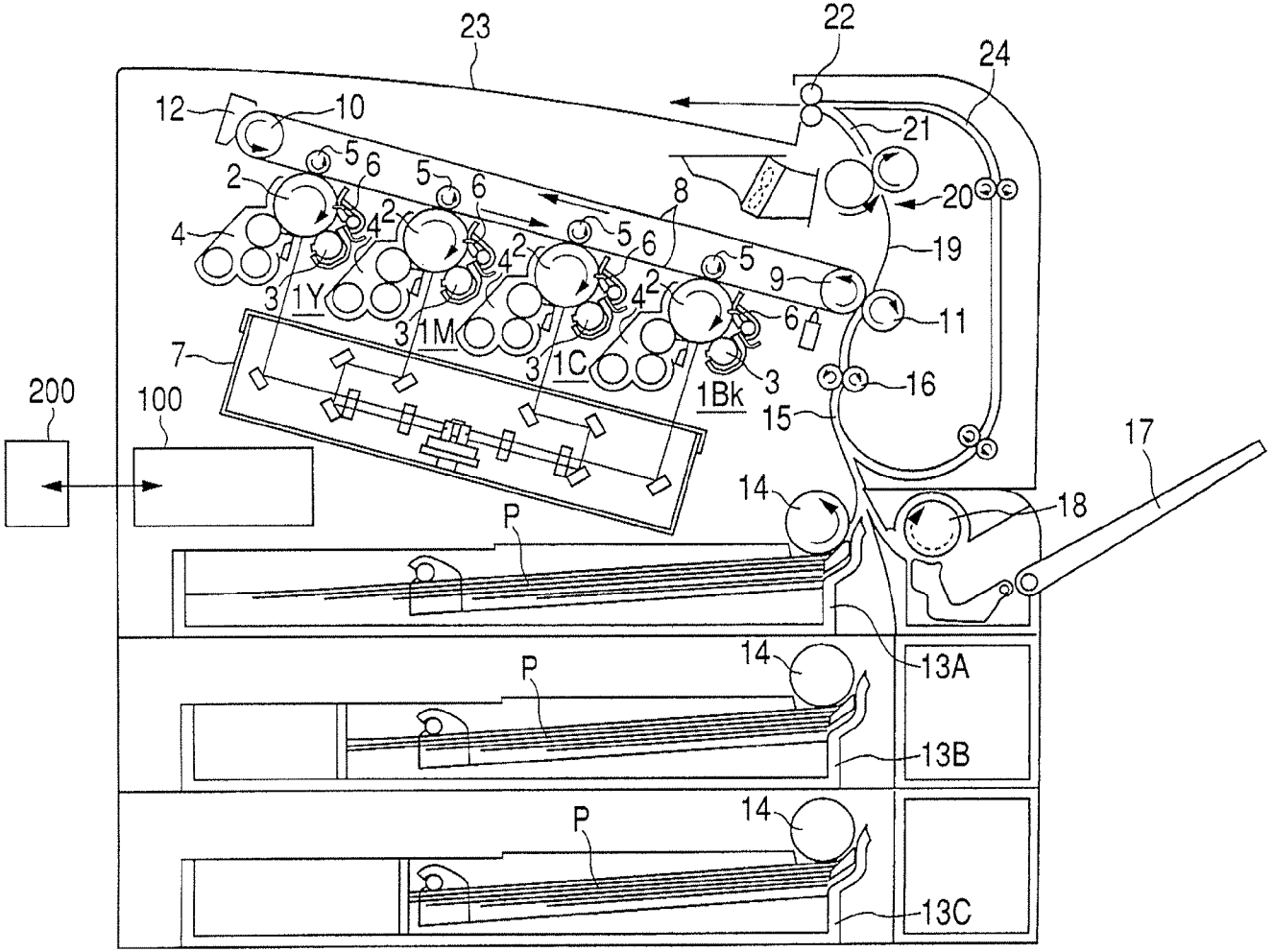
FIG. 4 is a longitudinal sectional view for showing an example of the image forming apparatus, which mounts the fixing apparatus of FIG. 3.

FIG. 4 is a longitudinal sectional view for schematically showing an arrangement of an electrophotographic full color printer corresponding to one example of an image forming apparatus according to the present invention. Firstly, an image forming portion corresponds to image forming means for forming an image on a recording material will be described.

The full color printer can perform an image forming operation based on input image information from an external host apparatus 200 communicate-ably connected to a control circuit portion (control board: CPU) 100 so as to form a full color image on a recording material, and then, can output the formed full color image.

The external host apparatus 200 corresponds to a computer, an image reader, and the like. The control circuit portion 100 transmits and receives a signal with respect to the external host apparatus 200. Also, the control circuit portion 100 transmits and receives signals with respect to various sorts of image forming appliances so as to perform image forming sequential control operation.

While an intermediate transfer belt (hereinafter, abbreviated as "belt") 8 which is made in an endless shape and is flexible is suspended between a secondary transfer opposed roller 9 and a tension roller 10, the belt 8 is rotary driven at a predetermined speed in a counterclockwise direction as indicated by an arrow because the roller 9 is driven. The secondary transfer roller 11 is brought into contact with the secondary transfer opposed roller 9 via the belt 8 under pressure condition. An abutting portion between the belt 8 and the secondary transfer roller 11 corresponds to a secondary transfer portion.

Four (4) sets of first to fourth image forming portions 1Y, 1M, 1C, and 1Bk are arranged in one column at predetermined intervals in a belt moving direction under the belt 8. Each of the image forming portions 1Y, 1M, 1C, and 1Bk corresponds to an electrophotographic process mechanism of a laser exposing system, and contains a drum type electrophotographic photosensitive member (hereinafter, abbreviated as "drum") 2 as an image bearing member. The image bearing member is rotary driven at a predetermined speed in a clockwise direction as represented by an arrow. Around of each of these drums 2, a primary charger 3, a developing apparatus 4, a transfer roller 5 as transferring means, and a drum cleaner apparatus 6 are arranged. While the respective transfer rollers 5 are arranged inside the belt 8, the respective transfer rollers 5 are brought into contact with the corresponding drums 2 via a down stream-sided belt portion of the belt 8 under pressure condition. An abutting portion between each of the drums 2 and the belt 8 corresponds to a primary transferring portion. Reference numeral 7 indicates a laser exposing apparatus with respect to the drums 2 of the respective image forming portions. The laser exposing apparatus is constituted by a laser light emitting means, a polygon mirror, a reflection mirror, and the like. The laser light emitting means emits laser light based on a time sequential electric digital pixel signal of given image information.

The control circuit portion 100 operates the respective first to fourth image forming portions 1Y, 1M, 1C, and 1Bk so as to perform an image forming operation based on color separation image signals entered from the external host apparatus 200. As a result, in the first to fourth image forming portions 1Y, 1M, 1C, and 1Bk, a yellow color toner image, a magenta color toner image, a cyan color toner image, and also a black color toner image are formed at predetermined control timing with respect to surfaces of the drums 2 which are rotated, respectively. It should be noted that because an electrophotographic image forming principle and process for forming toner images on the drums 2 belong to the known technical field, explanations thereof are omitted.

The above-mentioned toner images formed on the surfaces of the drum 2 of the respective image forming portions 1Y, 1M, 1C, and 1Bk are sequentially superimposed and transferred at the primary transfer portion in the forward direction with respect to the rotation directions of the respective drums 2 with respect to the outer surface of the belt 8, while the belt 8 is rotary driven at the speed corresponding to the rotation speed of the respective drums 2. As a consequence, unfixed full color toner images are synthesized with each other by superimposing the above-mentioned four toner images on the surface of the belt 8 to be formed.

On the other hand, a sheet feeding roller 14 of a sheet feeding cassette at a stage is driven at predetermined sheet feeding timing, which is selected from upper/lower multiple stages of cassette sheet feeding portions 13A, 13B, and 13C, which have stacked and stored recording materials "p" having various sorts of width sizes (larger and smaller widths). As a result, one sheet of recording materials P stacked up/stored in the sheet feeding cassette of the selected stage is separated and fed, and then is transported via a vertical transport path 15 to a registration roller 16. When a manual sheet feeding is selected, another sheet feeding roller 18 is driven. As a result, one sheet of recording materials P stacked up/set on a manual sheet feeding tray (a multi-purpose tray) 17 is separated and fed, and then is transported via the vertical transport path 15 to the registration roller 16.

The registration roller 16 transports a recording material "P" in such a manner that a leading edge portion of the recording material "P" may be reached to the secondary transfer portion in correspondence with such a timing when a leading edge portion of the above-mentioned full color toner image formed on the rotating belt 8 reaches the secondary transfer portion. As a consequence, in the secondary transfer portion, the full color toner images formed on the belt 8 are sequentially secondary-transferred to the surface of the recording material "P" collectively. The recording material "P" which is derived out from the secondary transfer portion is separated from the surface of the belt 8, and then, is guided by a longitudinal guide 19 to be introduced into a fixing apparatus (fixing device) 20. The above-mentioned toner images having the plural colors are melted and color-mixed with each other, and then, the melted toner images are fixed as a permanently fixed image on the surface of the recording material "P" by the fixing apparatus 20. The recording material "P" derived from the fixing apparatus 20 is transported as a full color image formed matter via the transport path 21 by a sheet discharging roller 22 onto a sheet discharging tray 23.

In the secondary transfer portion, the side of the belt 8 after the recording member is separated is cleaned by removing remaining attached articles such as secondary transfer remaining toners by a belt cleaning apparatus 12 so as to be repeatedly provided for forming images thereon.

In the case where a monochromatic print mode is selected, only the fourth image forming portion Bk for forming a black toner image is controlled based on an image forming operation. In the case where a two-side print mode is selected, a recording material of which a first side has already been printed is sent out onto the sheet discharging tray 23 by the sheet discharging roller 22, and at a time instant just before a trailing edge portion has passed through the sheet discharging roller 22, the rotation of the sheet discharging roller 22 is reversed. As a result, the recording material is switched back to be introduced into a re-transport path 24. Then, the introduced recording material is brought into a front/back side reversed state, and then, is again transported to the registration roller 16. Subsequently, similar to the image forming operation when the first side is printed, the recording material is transported to the secondary transfer portion and the fixing apparatus 20, and sent out onto the sheet discharging tray 23 as a two-side print image formed product.

(2) Fixing Apparatus 20

In the below-mentioned descriptions, as to either a fixing apparatus or a member which constitutes the fixing apparatus, a longitudinal direction corresponds to such a direction which is located parallel to a direction perpendicular to a transporting direction of a recording material in a transporting path plane of the recording material. With respect to the fixing apparatus, a front means a recording material introducing side, whereas a right and a left mean a right hand and a left hand of the fixing apparatus as viewed from the front of the fixing apparatus. A width of a recording material corresponds to a dimension of the recording material in a direction perpendicular to the transport direction of the recording material.

Figure 3:
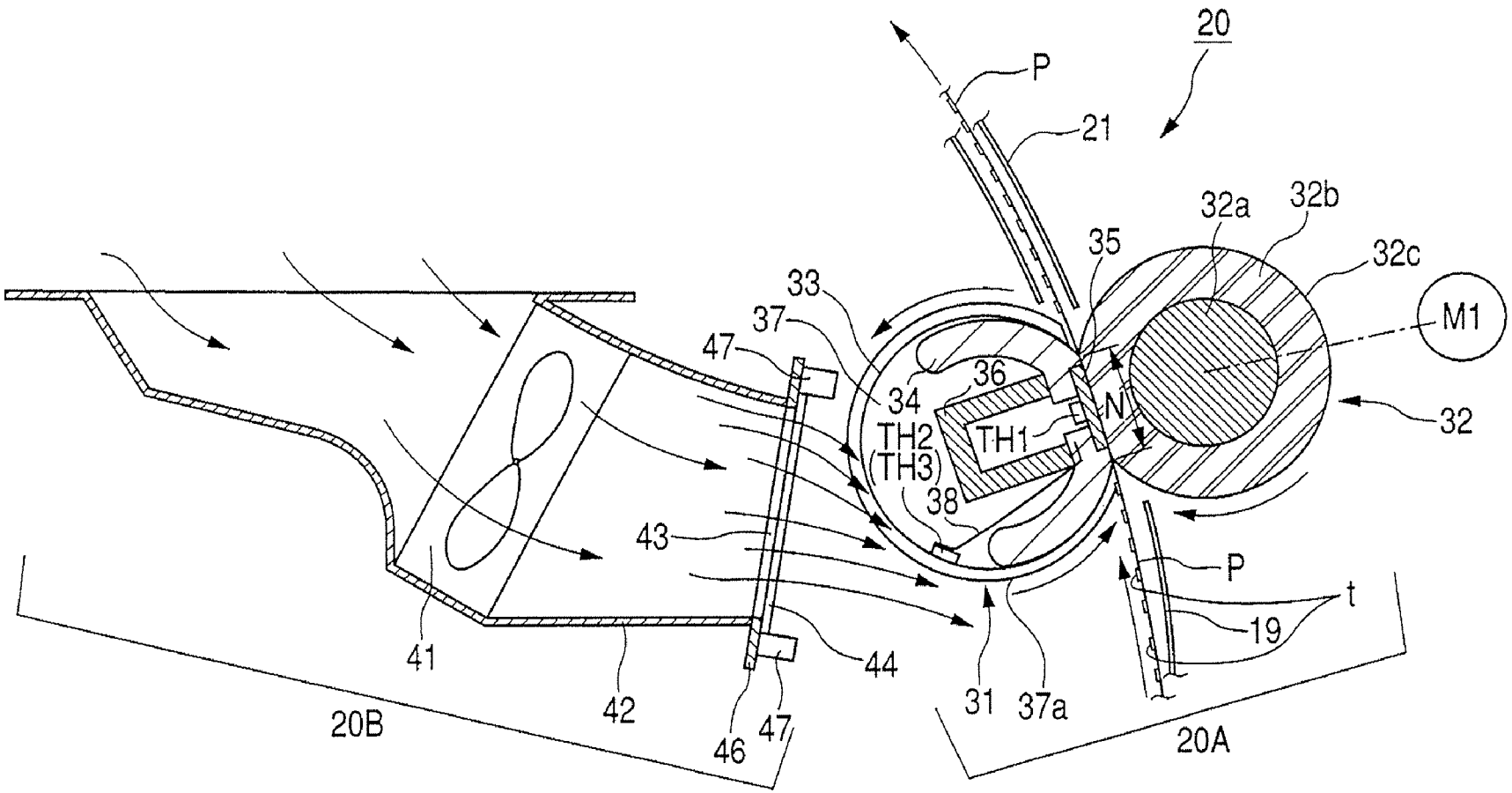
FIG. 3 is a lateral sectional view for schematically indicating an arrangement of a fixing apparatus image heating apparatus of the first embodiment.
Figure 5:
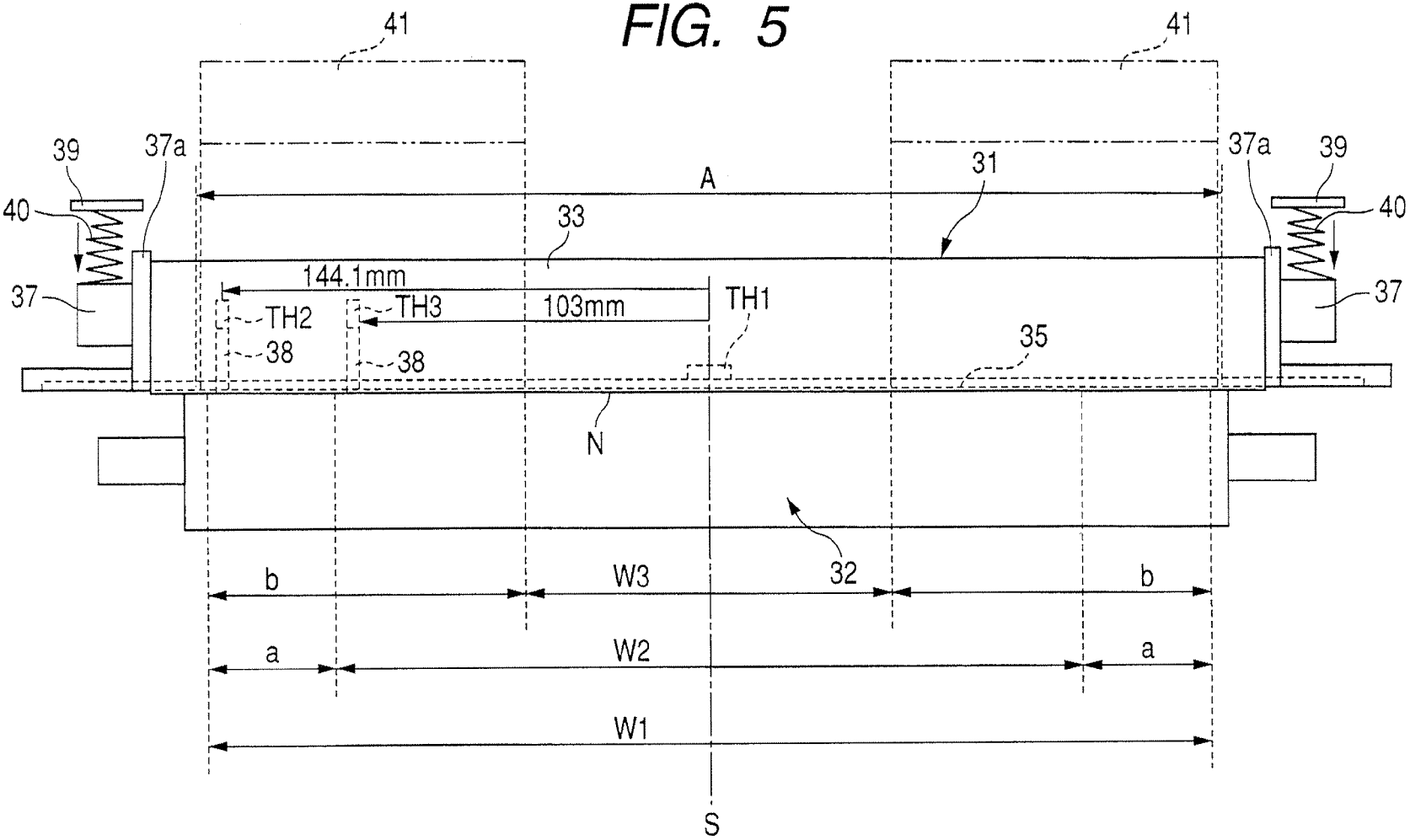
FIG. 5 is a front view for schematically indicating a fixing mechanism portion of the fixing apparatus of FIG. 3.
Figure 6:
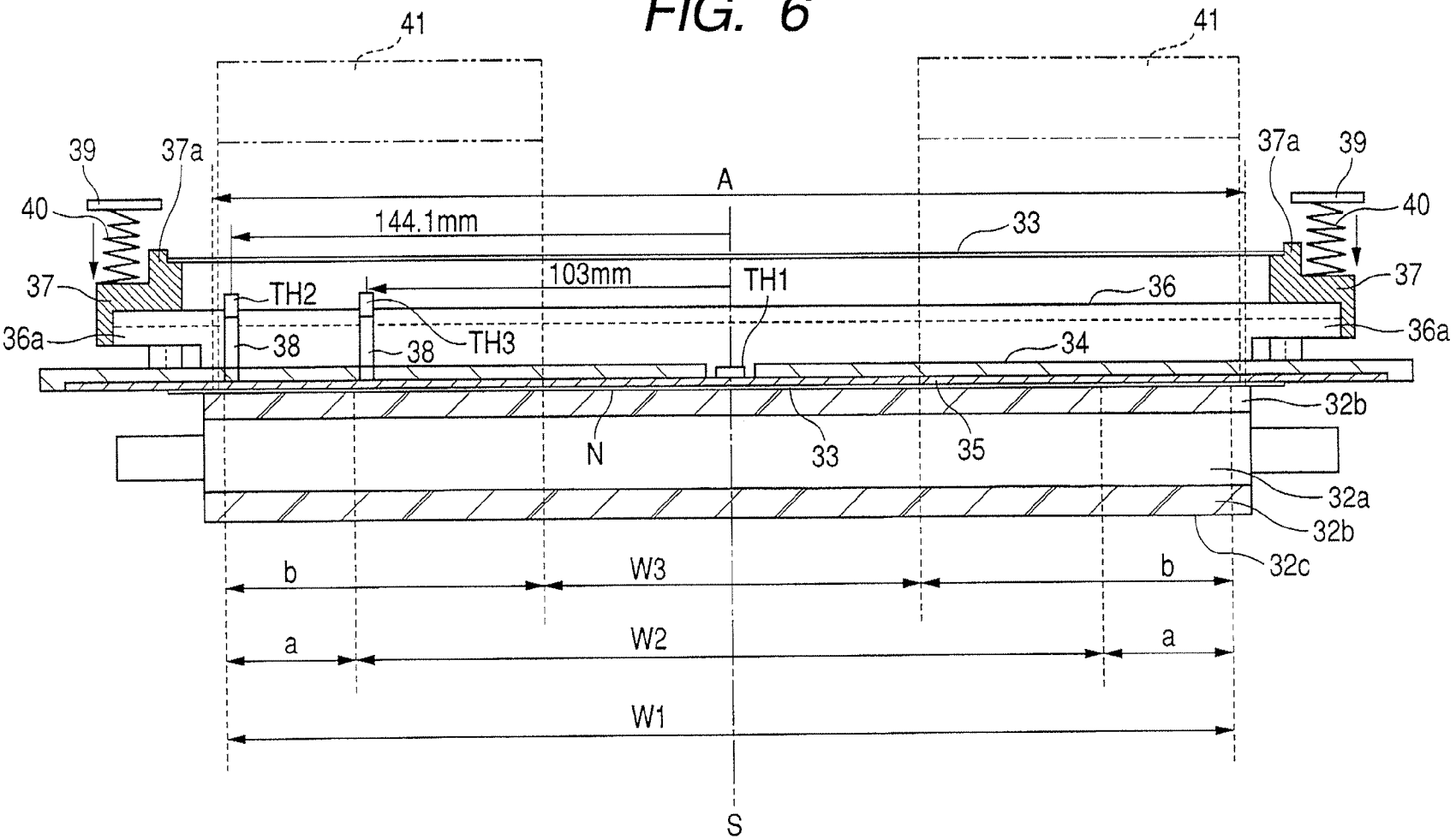
FIG. 6 is a longitudinal sectional frontal view of the fixing mechanism portion shown in FIG. 5.

FIG. 3 is a lateral sectional view for schematically showing an arrangement of the fixing apparatus 20 as an image heating apparatus according to the embodiment. The fixing apparatus 20 comprises mainly a belt (film) heating type fixing mechanism portion 20A and an air blowing cooling mechanism portion (cooling means) 20B. FIG. 5 is a front view for schematically showing the fixing mechanism portion 20A, and FIG. 6 is a longitudinal view for schematically indicating the fixing mechanism portion 20A.

(2-1) Fixing Mechanism Portion 20*a*

Firstly, an outline of the fixing mechanism portion 20A will now be explained. The fixing mechanism portion 20A basically corresponds to such a belt heating type/pressure rotary member driving type (tensionless type) on-demand fixing apparatus which is disclosed in Japanese Patent Application Laid-Open No. H04-44075 to Japanese Patent Application Laid-Open No. H04-44083, and Japanese Patent Application Laid-Open No. H04-204980 to Japanese Patent Application Laid-Open No. H04-204984.

A belt assembly 31 as a first fixing member (heating member) and an elastic pressure roller 32 as a second fixing member (pressure member) constitute a fixing nip (sheet passing nip) portion "N" by a pressure contact between the two.

The belt assembly 31 contains a cylindrical-shaped fixing belt 33 having a flexibility (fixing film, thin-walled roller: hereinafter, abbreviated as "belt"), a cross-sectional semi-arc trough shaped belt guide member 34 (hereinafter, abbreviated as "guide member") having a heat resistance and rigidity, and a ceramics heater 35 (hereinafter, abbreviated as "heater") as a heating source. The fixing belt 33 functions as an image heating member, which heats an image on a recording member in the nip portion "N." The ceramics heater 35 is arranged in such a way that the ceramics heater 35 is fitted into a concave groove portion formed in an outer surface of the guide member 34 in a longitudinal direction of the guide member 34 and is fixed. The belt 33 is outwardly and loosely fitted onto the guide member 34, which mounts thereon the heater 35. A U-shaped (as viewed in lateral section) type pressure stay 36 (hereinafter, abbreviated as "stay") having rigidity is arranged inside the guide member 34. An end holder 37 is fitted and fixed to outwardly projected arm portions 36*a* of right/left end portions of the stay 36. A flange portion 37*a* is formed integrally with the end holder 37.

The pressure roller 32 is such a roller, the hardness of which is reduced by employing an elastic layer 23*b* such silicone rubber on a cored bar 32*a*. In order to improve a surface characteristic, a fluororesin layer 32*c* such as PTFE, PFA, and FEP may be alternatively provided on an outer circumference. The pressure roller 32 is arranged as a pressure rotary member in such a manner that both end portions of the cored bar 32*a* are rotatably held via bearing members between right/left side plates of an apparatus chassis (not shown).

With respect to the above-mentioned pressure roller 32, the belt assembly 31 is arranged in a parallel manner while the heater side thereof is located opposite to the pressure roller 32, and a compression spring 40 is provided between the right/left end portion holders 37 and right/left fixed spring holding members 39 in a compression mode. As a result, the stay 36, the guide member 34, and the heater 35 are depressed and biased to the side of the pressure roller 32. While the depression biasing force is set to a predetermined value, the heater 35 is contacted to the pressure roller 32 by interposing the belt 33 under pressure against the elasticity of the elastic layer 32*b*, so the fixing nip portion "N" having a predetermined width is formed between the belt 33 and the pressure roller 32 in the transporting direction of the recording material.

Figure 7:
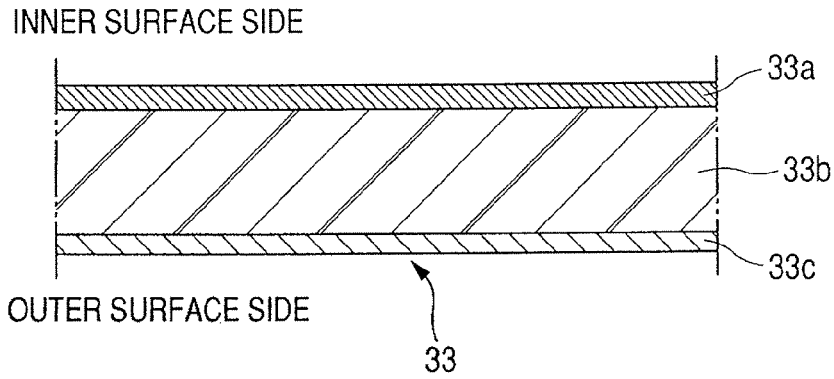
FIG. 7 is a schematic diagram for schematically showing a layer structure of a fixing belt.

As indicated in a layer structural schematic diagram of FIG. 7, the belt 33 employed in the first embodiment has a trilaminar structure constructed of a base layer 33*a*, an elastic layer 33*b*, and a releasing layer 33*c* in this order from an inner surface side to an outer surface side. As to the base layer 33*a*, in order to improve a quick starting characteristic by reducing a heat capacity, a heat resisting belt having a thickness smaller than, or equal to 100 μm, preferably such a thickness smaller than, or equal 50 μm, and larger than, or equal to 20 μm may be employed. For instance, belts made of polyimide, polyimideamide, PEEK, PES, PPS, PTFE, PFA, and FEP may be used. In this example, a cylindrical-shape polyimide belt having a diameter of 25 mm is employed. As to the elastic layer 33*b*, such a silicone rubber is employed, the rubber hardness of which is 10 degrees (JIS-A), the heat conductivity of which is $4.18605\times10^{-1}$ W/m·degree ($1\times10^{-3}$ [cal/cm.sec.deg]) and the thickness of which is 200 μm. As to the releasing layer 33*c*, a PFA coat layer having a thickness of 20 μm is employed. Alternatively a PFA tube may be employed. A PFA coat has the following superior points, as compared with a PFA tube: That is, a thickness of the PFA coat can be made thinner, and a toner wrapping effect is stronger in view of a material aspect. In other words, because both a mechanical strength and an electric strength of a PFA tube become superior, as compared with those of a PFA coat, these PFA tube and PFA coat may be selectively used.

Figure 8:
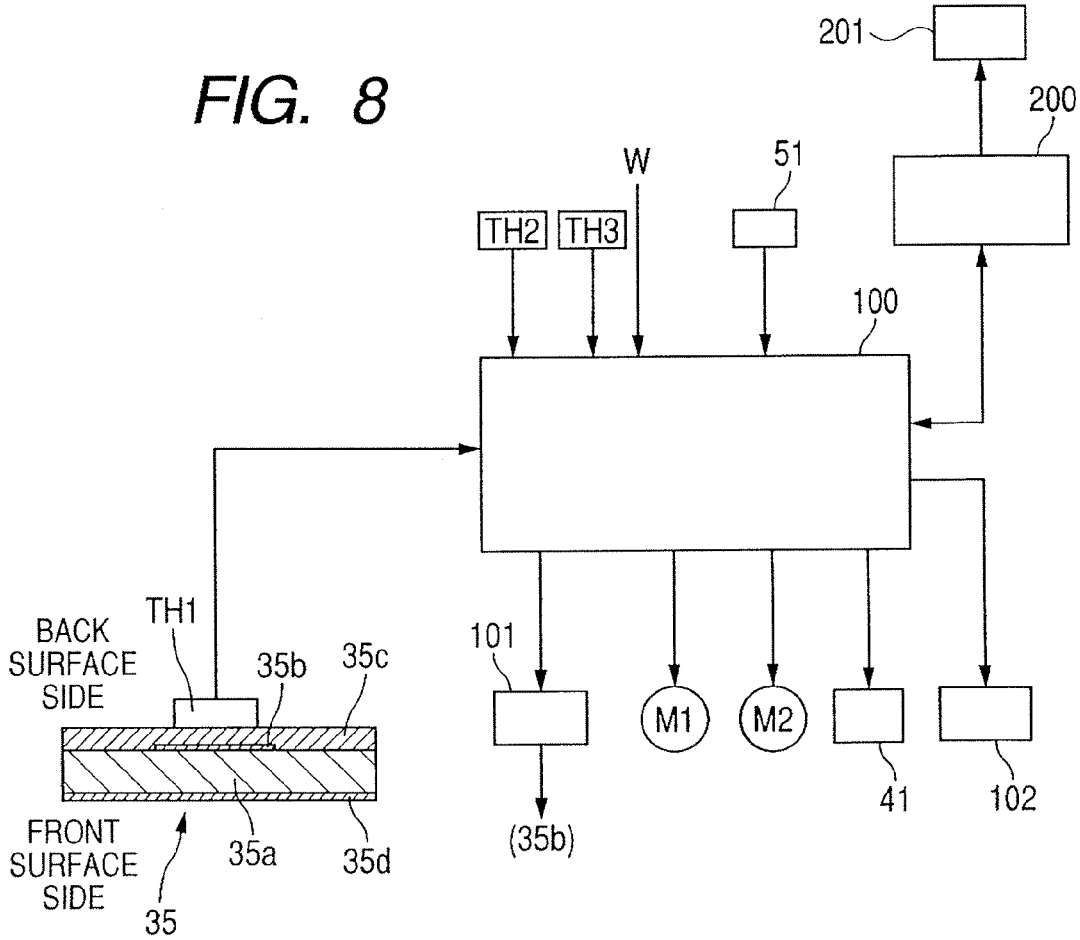
FIG. 8 is a lateral sectional view for schematically indicating a heater, and a block diagram of a control system thereof.

The heater 35 in the first embodiment corresponds to a back surface heating type heater with employment of aluminum nitride, or the like as a heater board, and corresponds to a line-shaped heating member having a low heat capacity. A lateral edge of the line-shaped heating member is longer, and a longitudinal edge thereof is coincident with a direction perpendicular to the transporting direction of the fixing belt 33 and the recording material "P". FIG. 8 is a lateral sectional view for schematically showing the heater 35 and a control system diagram of the heater 35. The heater 35 contains a heater board 35*a* made of aluminum nitride, or the like. An energizing heating layer 35*b* is provided on the back surface side (namely, such a surface side opposite to fixing belt opposing surface side) of the heater board 35*a* by coating an electric resistance material in the longitudinal direction. The electric resistance material is made of, for instance, Ag/Pd (argentine/palladium), or the like, and has a length of approximately 10 μm, and a width of 1 to 5 mm by way of a screen printing operation etc. Furthermore, the back surface side of the heater board 35*a* has a protection layer 35*c* which is made of glass, or fluororesin and is formed on the energizing heating layer 35*b*. In the first embodiment, a sliding member (lubricant member) 35*d* is provided on the front surface side (namely, belt opposing surface side) of the heater board 35*a*.

The heater 35 is fitted into a groove portion so as to be fixed and supported therein in such a manner that the front surface side of the heater board 35*a* where the sliding member 35*d* is formed is exposed. The groove portion is formed in the guide longitudinal direction at a substantially center portion of the outer surface of the guide member 34. In the fixing nip portion "N", a surface of the sliding member 35*d* of the heater 35 and an inner surface of the belt 33 are contacted to each other and are slid with each other. Then, the belt 33 corresponding to the rotating image heating member is heated by the heater 35.

Because both longitudinal end portions of the energizing heating layer 35*b* of the heater 35 are energized, the energizing heating layer 35*b* is heated, so a temperature of the heater 35 is rapidly increased over an entire area of an effective heating width "A" thereof in the heater longitudinal direction. The heater temperature is detected by a first temperature detecting means (hereinafter, referred to as "first thermistor") TH1 such as a thermistor, and then, an output (signal value related to heater temperature) is inputted via an A/D converter to a control circuit portion 100, while the first temperature detecting means TH1 is arranged by being contacted to the outer surface of the heater protection layer 35*c*. The control circuit portion 100 controls an energizing operation from a power supply (power supplying unit, and heater driving circuit unit) 101 with respect to the energizing heating layer 35*b* based on the detected temperature information to be inputted in such a manner that the heater temperature is maintained at a predetermined temperature. In other words, the temperature of the belt 33 corresponding to the image heating member heated by the heater 35 is controlled to become a predetermined fixing temperature based on the output value of the first thermistor TH1.

The embodiment 1 is set to such a system that a proportional control system is employed as the temperature control system, and such an electric power proportional to deviation between the setting value of the heater temperature and the temperature measured by the first thermistor TH1 is applied to the heater 35.

The pressure roller 32 is rotary driven by a motor (driving means) M1 in a counterclockwise direction indicate by an arrow. A rotation force is exerted to the belt 33 by a friction force produced by rotation of the pressure roller 32 in the fixing nip portion "N" between the pressure roller 32 and the outer surface of the belt 33. As a result, while the belt 33 is slid by close-contacting the inner surface of the belt 33 to the heater 35 in the fixing nip portion "N", the belt 33 is outwardly rotated around the guide member 34 in the counterclockwise direction indicated by the arrow (pressure roller driving system). The belt 33 is rotated at a circumferential speed nearly equal to the rotating circumferential speed of the pressure roller 32. The right and left flange portions 37*a* play a role of restricting a biased movement when the rotating belt 33 is moved by being biased to either a left hand or a right hand in the longitudinal direction of the guide member 34 in such a manner that the right and left flange portions 37*a* accept such a belt end portion of the biased movement. In order to reduce the mutual sliding friction force between the heater 35 and the inner surface of the belt 33 in the fixing nip portion "N", a sliding member 35*d* is arranged on the heater surface of the fixing nip portion "N", and a lubricant agent such as heat resisting grease is interposed between the inner surface of the belt 33 and the heater 35.

Then, based on a print starting signal, a rotation of the pressure roller 32 is started, and a heat-up operation of the heater 35 is commenced. Under such a condition that the rotation circumferential speed of the belt 33 becomes the steady speed, and the temperature of the heater 35 or the temperature of the belt 33 rises to a predetermined temperature, the recording material "P" on which a toner image "t" is carried is introduced into the fixing nip portion "N" in such a manner that the toner image carrying surface of the recording material "P" is located on the side of the belt 33. The recording material "P" is close contacted to the heater 35 via the belt 33 in the fixing nip portion "N", and is moved to pass the fixing nip portion "N" in combination with the belt 33. In the course of movement pass, the heat is applied to the recording material "P" by the belt 33 heated by the heater 35, so the toner image "t" is heated so as to be fixed on the surface of the recording material "P". The recording material "P" which has passed through the fixing nip portion "N" is separated from the surface of the belt 33, and then, is discharged and transported.

In the first embodiment, the transportation of the recording material "P" is performed at a center of the recording material "P", a so-called "central reference transportation." In other words, as to recording materials having any large/small widths which can be passed through the image forming apparatus, center portions (as viewed in width directions) of these recording materials pass through the center portion (as viewed in longitudinal direction) of the fixing belt 33. Symbol "S" indicates a central sheet-passing reference line (virtual line) of the relevant recording material.

Symbol "W1" denotes a sheet-passing width (maximum sheet-passing width) of a maximum width recording material which can pass through the image forming apparatus. In the first embodiment, the maximum sheet-passing width "W1" corresponds to an A4-size width 297 mm (A4 landscape feed). The effective heating area width "A" of the heater longitudinal direction is set to be slightly wider than the maximum sheet-passing width "W1." Symbol "W3" denotes a sheet-passing width (minimum sheet-passing width) of a minimum width recording material which can pass through the image forming apparatus. In the first embodiment, the minimum sheet-passing width "W3" corresponds to a postcard size width 100 mm (postcard portrait feed). Symbol "W2" corresponds to a sheet-passing width of such a recording material having a width between the maximum width recording material and the minimum width recording material. In the first embodiment, the sheet-passing width "W2" represents an A5-size width 210 mm (A5 landscape feed). In the below-mentioned description, a recording material having a width size corresponding to the maximum sheet-passing width W1 will be referred to as a maximum size recording material, and another recording material having a width narrower than the maximum sheet-passing width W1 will be referred to as a small size recording material.

Symbol "a" shows a difference width portion ((W1−W2)/2) between the maximum sheet-passing width W1 and the sheet-passing width "W2". Symbol "b" represents a difference width portion ((W1−W3)/2) between the maximum sheet-passing width "W1" and the minimum sheet-passing width "W3". In other words, the respective difference width portions are non-sheet passing portions, which are produced when either, an A5 portrait recording material or a postcard portrait recording material are passed which correspond to the small size recording materials. In the first embodiment, because the sheet recording material corresponds to the central reference, the non-sheet passing portions "a" and "b" are produced on right/left side portions of the sheet-passing width "W2", and on right/left side portions of the sheet-passing width "W3". The widths of these non-sheet passing portions are different from each other, depending on wider/narrower widths of small size recording materials, which are normally used.

The first thermistor TH1 is arranged in such a manner that the first thermistor TH1 detects a heater temperature (=sheet-passing portion temperature of belt 33) of a portion which is nearly coincident with the recording material central sheet-passing reference line S.

Symbol "TH2" indicates a second temperature detecting means such as a thermistor (hereinafter, referred to as "second thermistor"), and when a recording material to be passed is a recording material having a predetermined width, the second thermistor TH2 detects a temperature outside the recording material transporting area of the belt 33. The second thermistor TH2 is arranged at a free end of an elastic supporting member 38 having a leaf spring shape, the base portion of which is fixed to the guide member 34. Then, the second thermistor TH2 elastically abuts against the inner surface of the base layer 33*a* of the belt 33 due to elasticity of the elastic supporting member 38. The second thermistor TH2 is arranged in such a manner that the second thermistor TH2 is located near the belt end portion by 144.1 mm from the recording material central sheet-passing reference line S. The position of the second thermistor TH2 is located inside A4 (148.5 mm) and outside LTR (139.7 mm) in the central reference transportation.

Symbol "TH3" indicates a third temperature detecting means such as a thermistor (hereinafter, referred to as "third thermistor"), and when a recording material to be passed is a recording material having a predetermined width, the third thermistor TH3 detects a temperature in the vicinity of the end portion of the recording material transporting area of the belt 33. The third thermistor TH3 also is arranged at the free end of the elastic supporting member 38 having the leaf spring shape, the base portion of which is fixed to the guide member 34. Then, the third thermistor TH3 elastically abuts against the inner surface of the base layer 33*a* of the belt 33 due to elasticity of the elastic supporting member 38. The third thermistor TH3 is arranged in such a manner that the third thermistor TH3 is located near the belt end portion by 103 mm from the recording material central sheet-passing reference line S.

Any of outputs of the first thermistor TH1, the second thermistor TH2, and the third thermistor TH3 (namely, signal values related to temperature) is inputted via the A/D converter to the control circuit portion 100.

As described above, the control circuit portion 100 controls the energizing operation with respect to the energizing heating layer 35*b* from the power supply 101 based on the detected temperature information inputted from the first thermistor TH1 in such a way that the heater temperature is maintained at a predetermined temperature. In other words, the temperature of the belt 33 corresponding to the image heating member heated by the heater 35 is controlled to the predetermined fixing temperature based on the output of the first thermistor TH1.

It should also be noted that the first thermistor TH1 may be alternatively and elastically contacted to the base layer inner surface of the belt portion corresponding to the sheet-passing portion "W3". Conversely, the second and third thermistors TH2 and TH3 may be alternatively arranged so as to detect heater temperatures corresponding to the non-sheet passing portions.

(2-2) Air Blowing Cooling Mechanism Portion 20B

Figure 9:
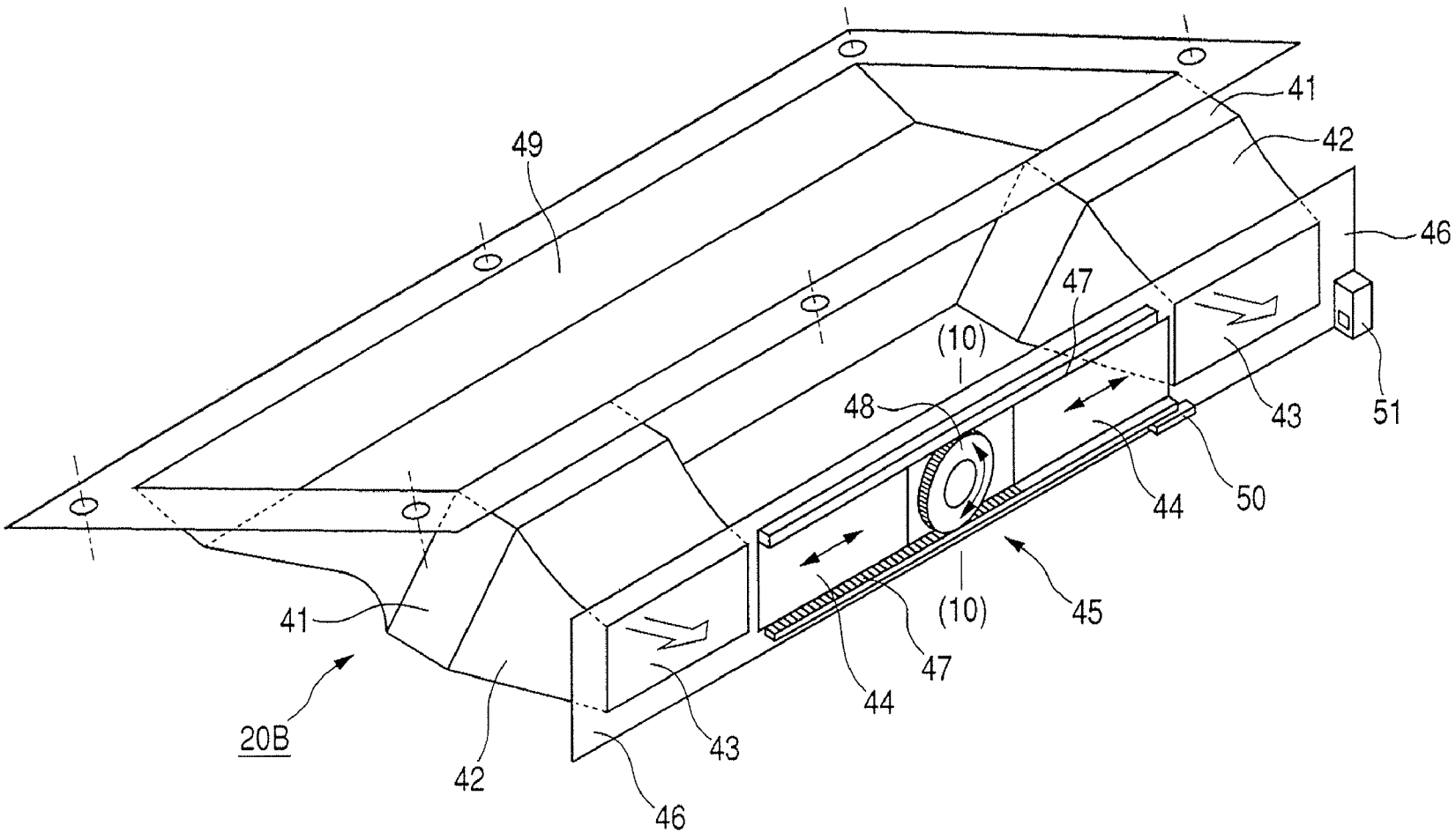
FIG. 9 is a perspective view for schematically indicating an outer appearance of an air blowing cooling mechanism portion.
Figure 10:
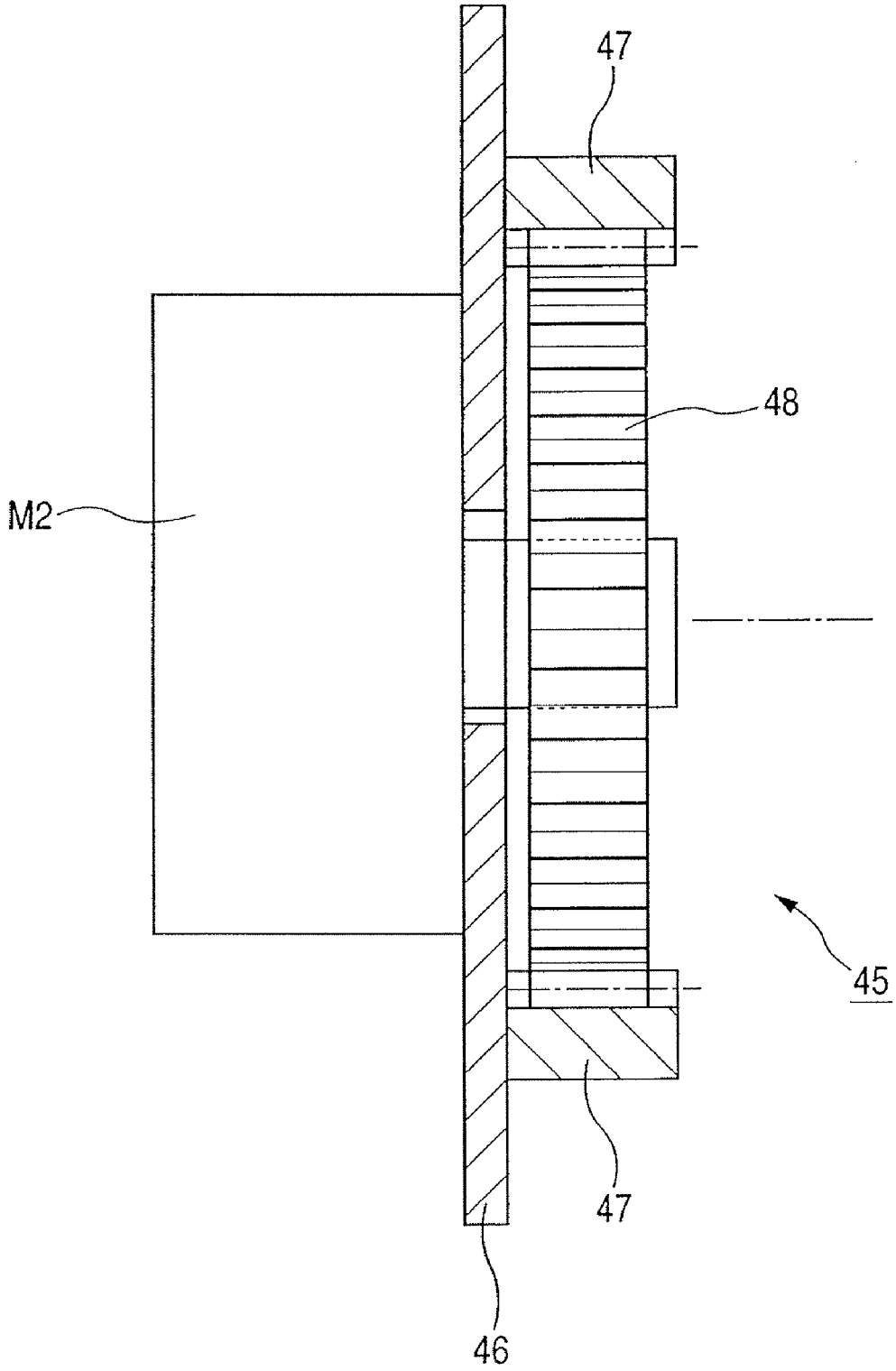
FIG. 10 is an enlarged sectional view of the air blowing cooling mechanism portion, taken along the line (10) to (10) of FIG. 9.

The air blowing cooling mechanism portion 20B is such cooling means for cooling a temperature rise of the non-sheet passing portion of the belt 33 by blowing air. The temperature rise occurs when a small size recording material is continuously passed (small size job). In other words, the air blowing cooling mechanism portion 20B corresponds to such cooling means for cooling an area (non-sheet passing portion) outside the recording material transporting area of the belt 33 as the image heating member, when a width of a recording material to be passed is set to a predetermined width. FIG. 9 is a perspective view for schematically showing an outer view of the air blowing cooling mechanism portion 20B. FIG. 10 is an enlarged sectional view of the air blowing cooling mechanism portion 20B, taken along the line (10)-(10) of FIG. 9.

Referring now to FIG. 3, FIG. 9, and FIG. 10, a description is provided of the air blowing cooling mechanism portion 20B according to the first embodiment. The air blowing cooling mechanism 20B contains an air blowing (cooling) fan (hereinafter, abbreviated as "fan") 41, an air blowing duct 42, and air blowing ports (duct opening portion) 43. The air blowing duct 42 conducts air produced by the fan 41. The air blowing ports 43 are arranged at a portion of the air blowing duct 42, which is located opposite to the fixing mechanism portion 20A. Also, the air blowing cooling mechanism portion 20B contains a shutter (closure plate) 44, and an opening width adjusting mechanism (shutter driving apparatus) 45. The shutter 44 adjusts an opening width of the air blowing ports 43 to be a width which is suitable for a width of a recording material to be passed. The opening width adjusting mechanism 45 drives the shutter 44.

The above-mentioned fan 41, air blowing duct 42, air blowing ports 43, and shutter 44 are symmetrically arranged on the right and left portions of the belt 33 in the longitudinal direction. Reference numeral 49 indicates an air intake channel portion arranged on the air intake side of the fan 41. As the above-mentioned fan 41, a centrifugal fan such as a sirocco fan may be used.

The right and left shutters 44 are slidably supported in the right/left directions along a plate surface of the supporting plate 46 which is extended in the right/left directions, in which the air blowing ports 43 are formed. The right and left shutters 44 are communicated with each other by employing a rack teeth 47 and a pinion gear 48, and the pinion gear 48 is driven by a motor (pulse motor) M2 in a normal rotation direction, or a reverse rotation direction. As a result, the right and left shutters 44 may be opened and closed in the right/left symmetrical relationship with respect to the air blowing ports 43 in the interconnection manner. The shutter driving apparatus 45 is arranged by the above-mentioned supporting plate 46, rack teeth 47, pinion gear 48, and motor M2.

The right and left air blowing ports 43 are provided from such a position slightly close to a center rather than the non-sheet passing portion "b" produced when the minimum width recording material is passed over the maximum sheet-passing width W1. The right and right shutters 44 are arranged from the longitudinal center of the supporting plate 46 to the outer portion in such a direction along which the air blowing ports 43 are closed only by a predetermined amount.

Width information W (FIG. 8) of a recording material is inputted into the control circuit portion 100, while the recording material is passed based on an input of a used recording material size by a user. Then, the control circuit portion 100 controls the shutter driving apparatus 45 based on the width information W. In other words, the motor M2 is driven so as to rotate the pinion gear 48 and move the shutters 44 by the rack teeth 47, so the air blowing ports 43 can be opened by a predetermined amount.

When the width information W of the recording material is the maximum size recording material (A4 landscape), the control circuit portion 100 controls the opening width adjusting mechanism 45 so as to move the shutters 44 to a fully closed position where the air blowing ports 43 are completely closed. When the width information W of the recording material is the small size recording material of a postcard, the control circuit portion 100 controls the opening width adjusting mechanism 45 so as to move the shutters 44 to a fully opened position where the air blowing ports 43 are completely opened. Further, when the width information W of the recording material is the small size recording material of the A5 landscape size, the control circuit portion 100 controls the opening width adjusting mechanism 45 so as to move the shutters 44 to such a position where the air blowing ports 43 are opened only by a portion corresponding to the non-sheet passing portion "a."

In the case where a small size recording material to be passed corresponds to LTR-R, EXE, K8, LTR etc., the control circuit portion 100 moves the shutters 44 to such positions where the air blowing ports 43 are opened by such portions which correspond to non-sheet passing portions produced in these cases.

In other words, the shutters 44 can adjust the opening widths of the air blowing ports 43 based on the width information W of the inputted recording material.

It should be understood that the minimum, maximum, and full recording material sizes in the first embodiment imply paper specifications guaranteed by the image forming apparatus main body, but do not imply indefinite size paper which is originally used by the user.

The positional information of the shutter 44 is detected by a sensor 51 which is arranged on the supporting plate 46 for supporting a flag 50 arranged at a predetermined position of the shutter 44. Concretely speaking, while a home position is determined at a shutter position where the air blowing ports 43 are fully closed, an opening amount is detected from a rotation amount of the motor M2.

Alternatively, while such an opening width sensor for directly detecting present positions of the shutters 44 may be equipped, shutter positional information detected by the opening width detection sensor may be fed back to the control circuit portion 100 so as to move the shutters 44 to proper opening width positions in correspondence with a width of a recording material to be passed. As to the stopping positions of the shutters 44, because edge positions of the shutters 44 are detected by a sensor, such a position corresponding to the length of the small size recording material in the width direction may be determined with higher precision. As a consequence, the cooling wind may be blown only with respect to the non-sheet passing portion of the full small size recording material.

(2-3) Control Sequence

Figure 1:
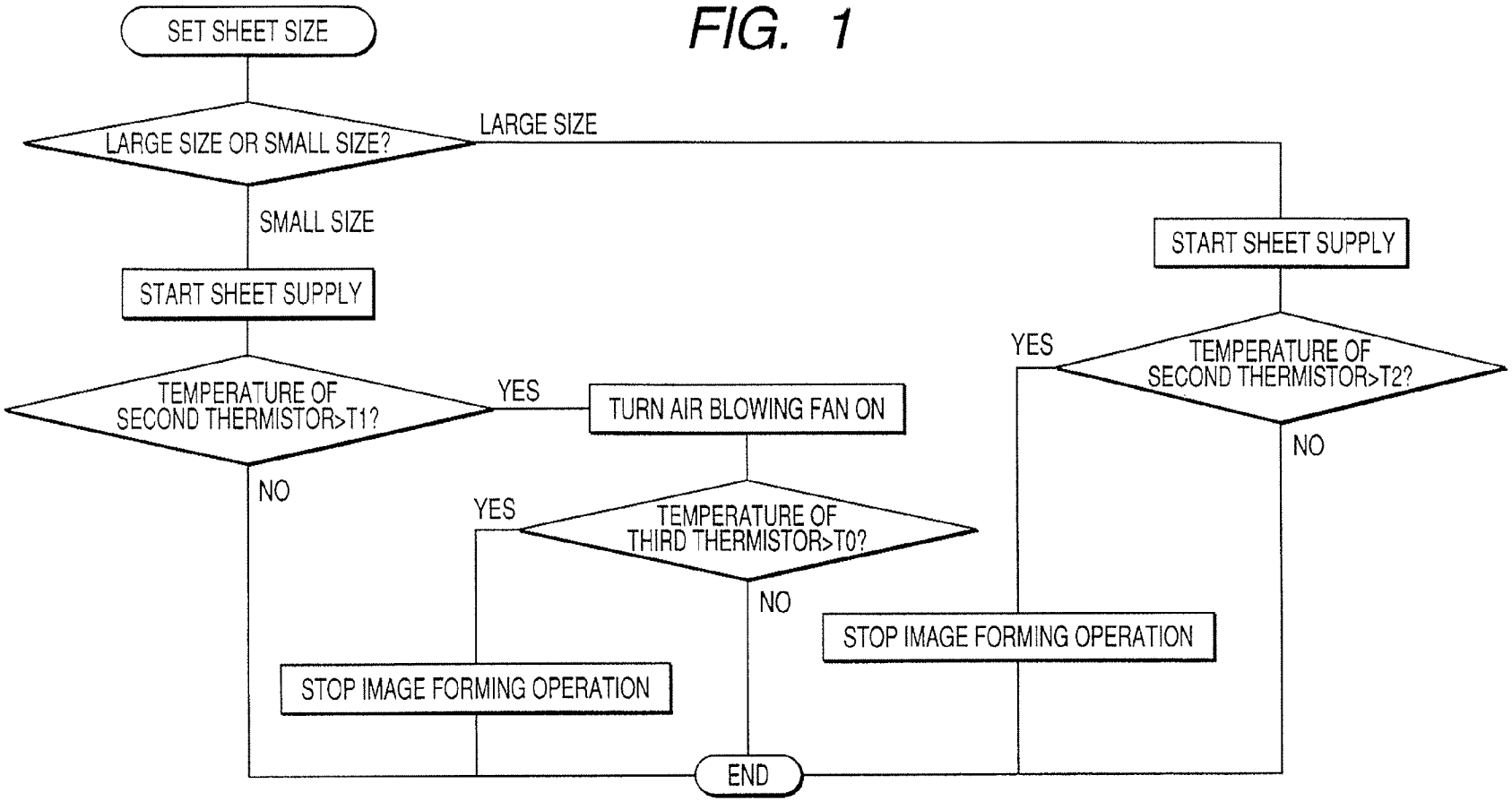
FIG. 1 is a control sequence diagram (No. 1) executed in an image forming apparatus according to a first embodiment of the present invention.

FIG. 1 is a control sequence diagram in the first embodiment. When an image forming operation is carried, in the case where a small size recording material having a narrower width than that of the above-mentioned maximum size recording material is continuously fixed, a temperature of a non-sheet passing portion is increased. The second thermistor TH2 detects a temperature at a belt inner surface of the non-sheet passing portion. When the second thermistor TH2 detects a predetermined temperature T1, while the control circuit portion 100 controls the opening width adjusting mechanism 45 so as to open the shutters 44 to opening widths corresponding to a set recording material size, the control circuit portion 100 starts to operate the air blowing fan 41 (namely, air blowing fan is turned ON). As a result, the temperature rise of the non-sheet passing portion can be suppressed. Then, in such a case where because the non-sheet passing portion is cooled by the cooling wind of the air blowing fan 41, the detected temperature of the second thermistor TH2 is lowered to a predetermined temperature, the control circuit portion 100 stops the operation of the air blowing fan 41.

In such an apparatus that a recording material width is not automatically detected, the user arbitrarily sets a size of a recording material, and the shutters 44 are adjusted by an opening width corresponding to a non-sheet passing width which is produced by the set recording material size. At this time, for example, when the user sets a postcard (recording material width, 50 mm from center) to the sheet feeding portion, and also sets a recording material having the A5 size (recording material width, 105 mm from center), the shutters 44 are moved to such an opening width corresponding to the set A5 size paper. However, because the postcard is actually passed, the cooling wind by the air blowing fan 41 is not blown to the fixing belt portions from A5 edge to postcard edge, so a temperature raised portion is produced. Then, the temperature of the belt portion of the third thermistor TH3 (103 mm from center) is increased. When the detected temperature of the third thermistor TH3 reaches a predetermined temperature "T0", the control circuit portion 100 judges that the recording material is erroneously set, and thus, stops the image forming operation.

Also, similar to such a case where the small size paper is passed through the conventional fixing apparatus structure where the air blowing fan 41 is not operated when the large size paper is passed, when an erroneous setting operation of a recording material occurs, if the detected temperature of the second thermistor TH2 reaches a temperature T2, the control circuit portion 100 judges the erroneous setting operation of the recording material and stops the image forming operation.

The control circuit portion 100 stops the image forming operation, and displays such a message that the recording material is erroneously set on either a display means 102 or a display means 201 (see FIG. 8) such as a liquid crystal display device. The display means 102 corresponds to a display means provided on the side of the image forming apparatus. The display means 201 corresponds to such a display means provided on the side of the external host apparatus 200.

As described above, when the erroneous setting operation of the recording material occurs, because the image forming operation is stopped, the safety characteristic at the apparatus in the case where the cooling area caused by erroneously setting the recording material is different from the size of the recording material to be passed can be secured.

Figure 2:
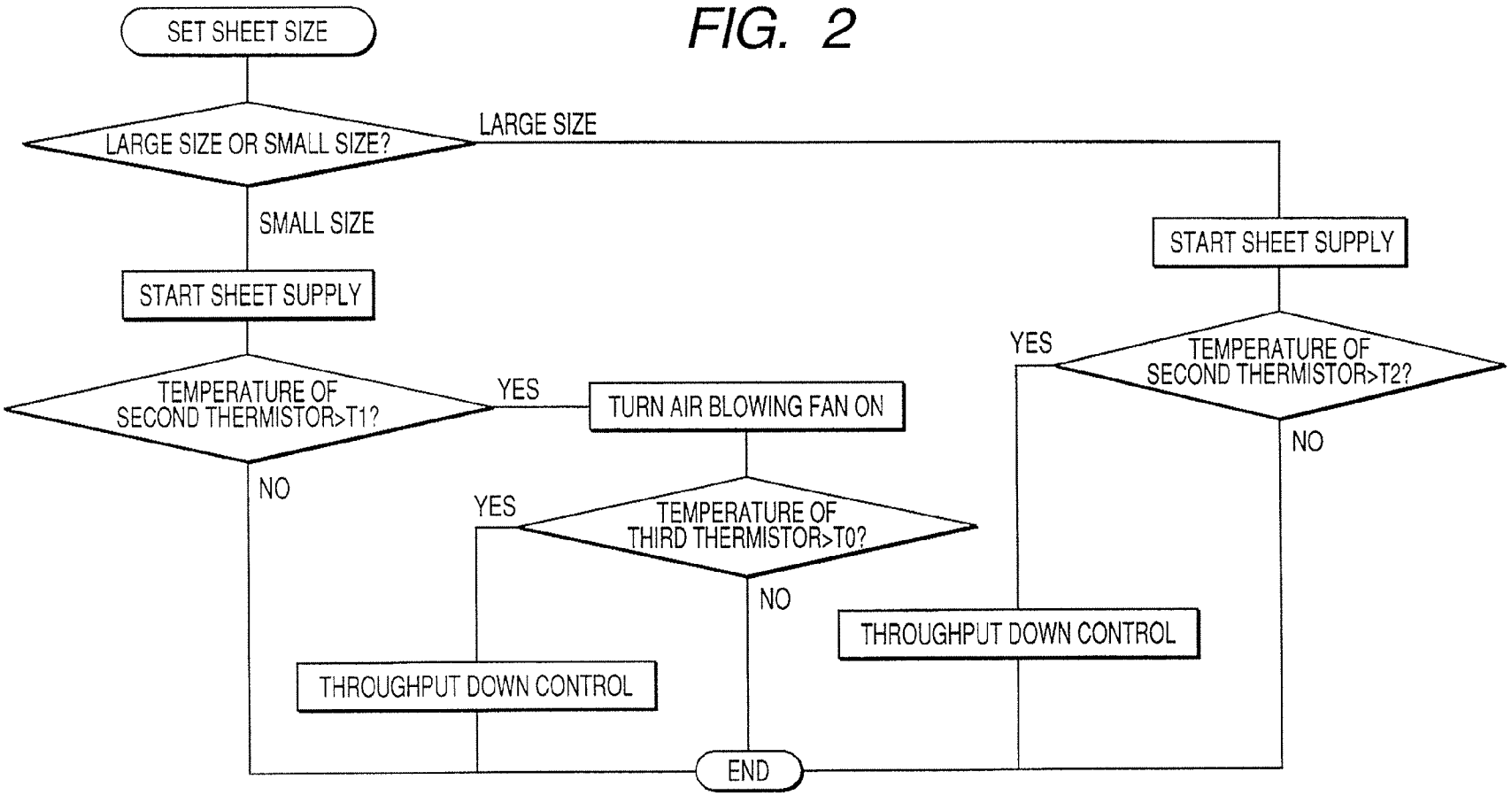
FIG. 2 is a control sequence diagram (No. 2) executed in the image forming apparatus according to the first embodiment.

FIG. 2 shows another control sequence diagram. It should be noted that a throughput down control operation indicated in FIG. 2 implies such a control operation for reducing a total number of recording materials which pass through the fixing nip portion "N" per unit time. The throughput down control operation involves a control operation for lowering a discharging speed of a recording material by the fixing apparatus, and another control operation for increasing an interval between recording materials which pass through the fixing apparatus.

When an image forming operation is carried out, in the case where a small size recording material having a narrower width than that of the above-mentioned maximum size recording material is continuously fixed, a temperature of a non-sheet passing portion is increased. The second thermistor TH2 detects a temperature at an inner surface of the fixing belt 33. When the second thermistor TH2 detects a predetermined temperature T1, while the control circuit portion 100 controls the opening width adjusting mechanism 45 so as to open the shutters 44 to opening widths corresponding to a set recording material size, the control circuit portion 100 starts to operate the air blowing fan 41 (namely, air blowing fan is turned ON). As a result, the temperature rise of the non-sheet passing portion can be suppressed. Then, in such a case where because the non-sheet passing portion is cooled by the cooling wind of the air blowing fan 41, the detected temperature of the second thermistor TH2 is lowered to a predetermined temperature, the control circuit portion 100 stops the operation of the air blowing fan 41.

Next, a description is made of the throughput down control operation when the paper erroneous setting operation occurs. The normal throughput down control operation is carried out when the detected temperature of the second thermistor TH2 reaches the predetermined temperature T2 and is arranged so as to sense the fixing belt temperature of the non-sheet passing portion while small size paper is continuously passed. Both the throughput down control operation is carried out and the temperature of the second thermistor TH2 is kept lower than, or equal to the predetermined temperature T2 in order to prevent an abnormal fixing image such as a hot offset.

In the fixing apparatus of the first embodiment, the temperature rise of the non-sheet passing portion is prevented by the air blowing fan 41. As a result, when the normal air blowing fan is operated, the above-mentioned throughput down control operation is carried out, and there is no fear of lowering the productivity.

In such an apparatus that a paper width is not automatically detected, the user arbitrarily sets a paper size, and the shutters 44 are adjusted by an opening width corresponding to a non-sheet passing width which is produced by the set paper size. At this time, for example, when the user sets a postcard (recording material width, 50 mm from center) to the sheet feeding portion, and also sets a paper having the A5 size (recording material width, 105 mm from center), the shutters 44 are moved to such an opening width corresponding to the set A5 size paper. However, because the postcard is actually passed, the cooling wind by the air blowing fan 41 is not blown to the fixing belt portions from A5 edge to postcard edge, so a temperature raised portion is produced.

Then, the temperature of the fixing belt portion of the third thermistor TH3 (103 mm from center) is increased. When the detected temperature of the third thermistor TH3 reaches a predetermined temperature "T0", the control circuit portion 100 judges that the paper is erroneously set, and performs the throughput down control operation.

As a consequence, the excessive temperature rise caused by erroneously setting the paper can be prevented, and the image forming operation can be accomplished without ceasing the printing operation.

Also, similar to such a case where the small size paper is passed through the conventional fixing apparatus structure where the air blowing fan 41 is not operated when the large size paper is passed, in the case where an erroneous setting operation of a paper occurs, if the detected temperature of the second thermistor TH2 reaches a temperature T2, the throughput down control operation is carried out.

When the small size paper is passed under which the air blowing fan 41 is operated, the second thermistor TH2 is employed in order to control the ON/OFF operations of the air blowing fan 41, whereas the third thermistor TH3 is employed so as to perform the throughput down control operation when the paper is erroneously set.

Embodiment 2

Figure 11:
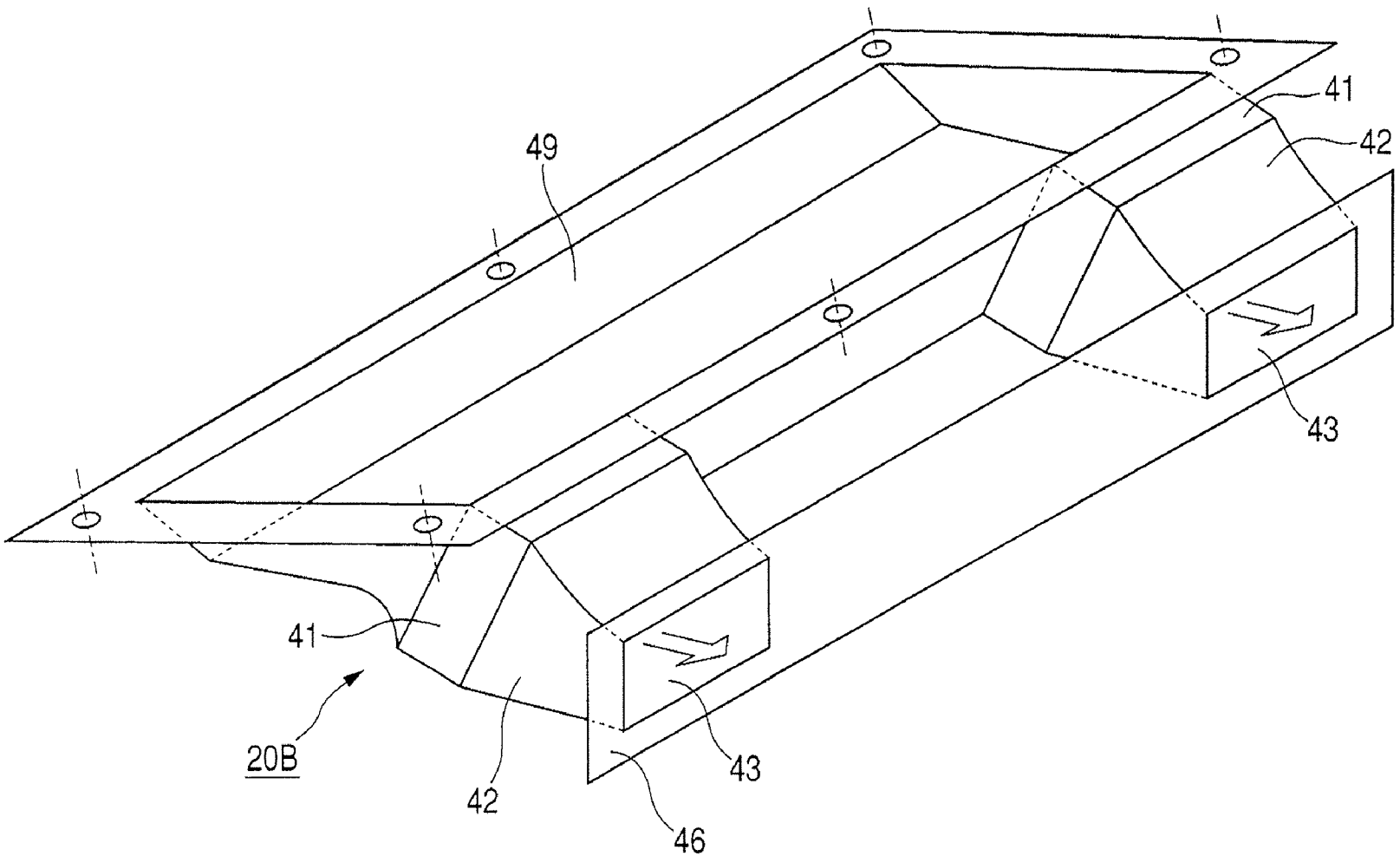
FIG. 11 is a perspective view for schematically showing an outer appearance as to an air blowing cooling mechanism portion without employing an opening width adjusting mechanism in an image forming apparatus according to a second embodiment of the present invention.

As shown in FIG. 11, an arrangement of an image forming apparatus according to a second embodiment of the present invention is featured by that such an opening width adjusting mechanism 45 as explained in the above-mentioned embodiment 1 is not provided in the air blowing cooling mechanism portion 2B, but an opening width of a duct opening unit 43 corresponds to, for example, a width of a non-sheet passing portion of an A5 landscape. At this time, the opening width of the duct must be set not only to the A5 landscape, but also to a reuse frequency small size of a main body.

Similar to FIG. 5 and FIG. 6 of the first embodiment, also in the third embodiment, three sets of first to third thermistors TH1 to TH3 are contained. Also, in the second embodiment, the first thermistor TH1 is used in order to control a temperature of the heater 35 (=belt 33). When a small size paper is passed under which the air blowing fan 41 is operated, the second thermistor TH2 is employed so as to perform ON/OFF control operations of the air blowing fan 41. Both the second thermistor TH2 and the third thermistor TH3 are employed in control operations when a paper is erroneously set.

A detecting operation executed when the paper is erroneously set, a control operation executed after the above-mentioned detecting operation is carried out, and effects achieved when these operations are carried out are similar to those of the first embodiment.

Figure 12:
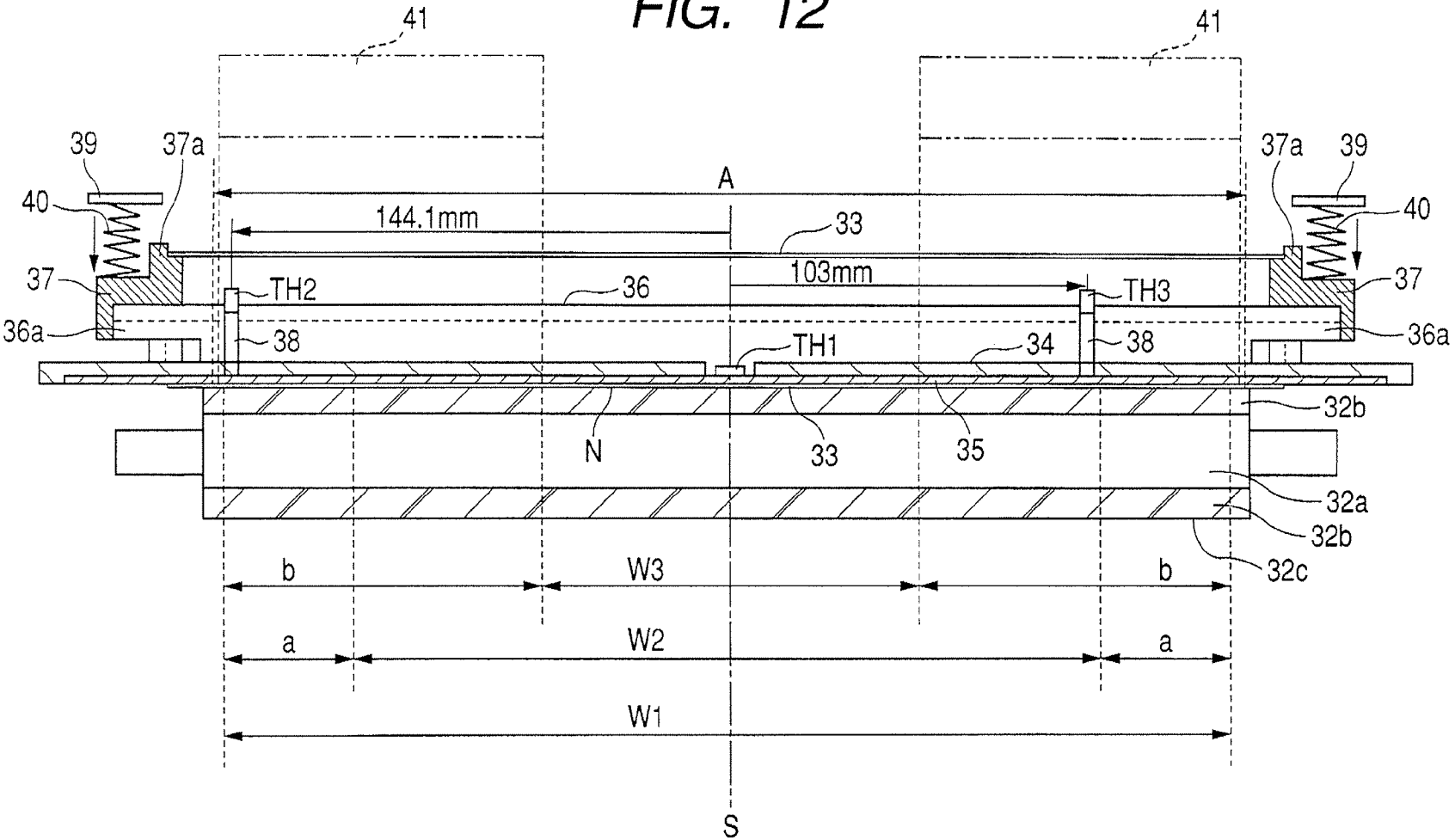
FIG. 12 is a diagram for representing another arranging example of a second thermistor TH2 and a third thermistor TH3.

As indicated in FIG. 12, the second thermistor TH2 and the third thermistor TH3 may be alternatively arranged on the reverse sides with respect to the first thermistor TH1. In other words, the third thermistor TH3 may be arranged in order to detect a temperature of the belt 33 at such a position which is shorter than a position of the second thermistor TH2 from the first thermistor TH1.

Although the fan 41 is arranged in order to cool the fixing member in the above-mentioned explanation, even if the fan 41 is arranged so as to cool the pressure member, then a similar effect may be achieved.

The cooling means is not limited only to a fan cooling mechanism.

Although the above-mentioned heating member (fixing member) is constructed of the thin-walled roller type heating member having the low heat capacity, the present invention is not especially limited only to the roller type heating member. Alternatively, even when a belt type fixing member is employed, a similar effect may be achieved.

The image heating means 20A is not limited only to the film heating type heating apparatus employed in the first embodiment, but may be realized as a heat roller type heating apparatus and heating apparatus having other structures. Alternatively, an electromagnetic induction heating type heating apparatus may be employed.

Also, even when the image heating means 20A may be arranged by that a recording material is passed based on a one-sided transportation, a similar effect may be achieved.

In the image forming apparatus according to the above-mentioned embodiment 2 of the present invention, it is possible to prevent the temperature rise of the non-sheet passing portion when the small size recording material is passed; it is possible to avoid the destruction of the image forming apparatus caused by the over temperature rise in such a case where a recording material size recognized by the apparatus is different from a size of a recording material to be passed; and such a printing operation which is not fitted to the size of the recording material is not carried out. Also, the printing operation can be completely accomplished.

Embodiment 3

Next, a description is made of an image forming apparatus according to a third embodiment. It should be noted that the same reference numerals explained in the embodiments 1 and 2 would be employed as those for denoting the same, or similar structural members and functions in the third embodiment.

If such a cooling arrangement is constituted which cools non-sheet passing portions in correspondence with recording materials having all width sizes which are different from each other, then an opening width adjusting mechanism becomes bulky, or complex, which may impede that not only a fixing apparatus, but also an image forming apparatus are made compact and in low cost.

For example, in order to form an opening over an entire non-sheet passing area as to a size (100 mm size) of a postcard in a width direction, an opening width adjusting plate becomes larger than the width direction size of the fixing apparatus. Although the bulky opening width adjusting plate may be avoided by constructing, for example, the opening width adjusting plate in the form of a so-called "bellows shape", the manufacturing cost of the opening width adjusting plate is increased. In other words, it is impossible to solve two aspects at the same time: lowering of productivity as to a small-size-width recording material in the belt fixing apparatus, and the stress of the user with respect to the compact and low cost aspects of the fixing apparatus (eventually, image forming apparatus) cannot be solved at the same time.

Under such a circumstance, in the third embodiment, while the image heating apparatus need not be made bulky and complex unnecessarily, the image forming apparatus does not perform a cooling process operation with respect to a recording material having a width size which is narrower than, or equal to a predetermined width, but executes the cooling process operation with respect to such a recording material having a width size which exceeds the predetermined width. The arrangements of the image forming apparatus will now be sequentially explained.

(1) Image Forming Portion

Figure 16:
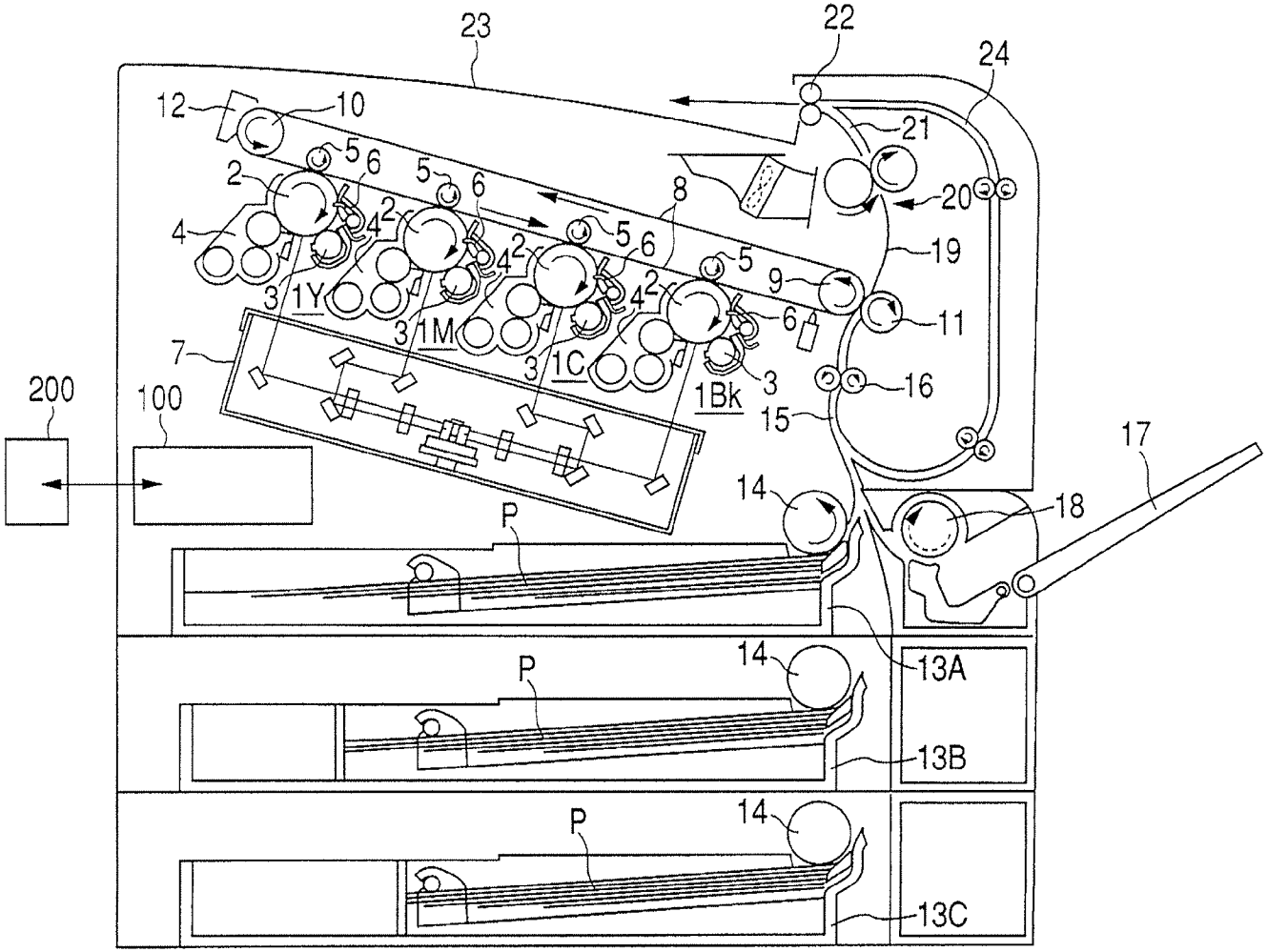
FIG. 16 is a longitudinal sectional view for showing an example of the image forming apparatus, which mounts the fixing apparatus of FIG. 15.

FIG. 16 is a longitudinal sectional view for schematically showing an arrangement of an electrophotographic full color printer corresponding to one example of an image forming apparatus which mounts an image heating apparatus as a fixing apparatus. Firstly, an image forming portion is summarized.

The full color printer can perform an image forming operation based on input image information from an external host apparatus 200 communicate-ably connected to a control circuit portion (control board: CPU) 100 so as to form a full color image on a recording material, and then, can output the formed full color image.

The external host apparatus 200 corresponds to a computer, an image reader, and the like. The control circuit portion 100 transmits and receives a signal with respect to the external host apparatus 200. Also, the control circuit portion 100 transmits and receives signals with respect to various sorts of image forming appliances so as to perform image forming sequential control operation.

While an intermediate transfer belt (hereinafter, abbreviated as "belt") 8 which is made in an endless shape and is flexible is suspended between a secondary transfer opposed roller 9 and a tension roller 10, the belt 8 is rotary driven at a predetermined speed in a counterclockwise direction as indicated by an arrow because the roller 9 is driven. The secondary transfer roller 11 is brought into contact with the secondary transfer opposed roller 9 via the belt 8 under pressure condition. An abutting portion between the belt 8 and the secondary transfer roller 11 corresponds to a secondary transfer portion.

Four (4) sets of first to fourth image forming portions 1Y, 1M, 1C, and 1Bk are arranged in one column at predetermined intervals in a belt moving direction under the belt 8. Each of the image forming portions 1Y, 1M, 1C, and 1Bk corresponds to an electrophotographic process mechanism of a laser exposing system, and contains a drum type electrophotographic photosensitive member (hereinafter, abbreviated as "drum") 2 as an image bearing member. The image bearing member is rotary driven at a predetermined speed in a clockwise direction as represented by an arrow. Around of each of these drums 2, a primary charger 3, a developing apparatus 4, a transfer roller 5 as a transferring means, and a drum cleaner apparatus 6 are arranged. While the respective transfer rollers 5 are arranged inside the belt 8, the respective transfer rollers 5 are brought into contact with the corresponding drums 2 via a down stream-sided belt portion of the belt 8 under pressure condition. An abutting portion between each of the drums 2 and the belt 8 corresponds to a primary transferring portion. Reference numeral 7 indicates a laser exposing apparatus with respect to the drums 2 of the respective image forming portions. The laser exposing apparatus is constituted by a laser light emitting means, a polygon mirror, a reflection mirror, and the like. The laser light emitting means emits laser light based on a time sequential electric digital pixel signal of given image information.

The control circuit portion 100 operates the respective first to fourth image forming portions 1Y, 1M, 1C, and 1Bk so as to perform an image forming operation based on color separation image signals entered from the external host apparatus 200. As a result, in the first to fourth image forming portions 1Y, 1M, 1C, and 1Bk, a yellow color toner image, a magenta color toner image, a cyan color toner image, and also a black color toner image are formed at predetermined control timing with respect to surfaces of the drums 2 which are rotated, respectively. It should be noted that because an electrophotographic image forming principle and process for forming toner images on the drums 2 belong to the known technical field, explanations thereof are omitted.

The above-mentioned toner images formed on the surfaces of the drum 2 of the respective image forming portions 1Y, 1M, 1C, and 1Bk are sequentially superimposed and transferred at the primary transfer portion in the forward direction with respect to the rotation directions of the respective drums 2 with respect to the outer surface of the belt 8, while the belt 8 is rotary driven at the speed corresponding to the rotation speed of the respective drums 2. As a consequence, unfixed full color toner images are synthesized with each other by superimposing the above-mentioned 4 toner images on the surface of the belt 8 to be formed.

On the other hand, a sheet feeding roller 14 of a sheet feeding cassette at a stage is driven at predetermined sheet feeding timing, which is selected from upper/lower multiple stages of cassette sheet feeding portions 13A, 13B, and 13C, which have stacked and stored recording materials "p" having various sorts of width sizes (larger and smaller widths). As a result, one sheet of recording materials P stacked up/stored in the sheet feeding cassette of the selected stage is separated and fed, and then is transported via a vertical transport path 15 to a registration roller 16. When a manual sheet feeding is selected, another sheet feeding roller 18 is driven. As a result, one sheet of recording materials P stacked up/set on a manual sheet feeding tray (a multi-purpose tray) 17 is separated and fed, and then is transported via the vertical transport path 15 to the registration roller 16.

The registration roller 16 transports a recording material "P" in such a manner that a leading edge portion of the recording material "P" may be reached to the secondary transfer portion in correspondence with such a timing when a leading edge portion of the above-mentioned full color toner image formed on the rotating belt 8 reaches the secondary transfer portion. As a consequence, in the secondary transfer portion, the full color toner images formed on the belt 8 are sequentially secondary-transferred to the surface of the recording material "P" in a unified manner. The recording material "P" which is derived out from the secondary transfer portion is separated from the surface of the belt 8, and then, is guided by a longitudinal guide 19 to be introduced into a fixing apparatus (fixing device) 20. The above-mentioned toner images having the plural colors are melted and color-mixed with each other, and then, the melted toner images are fixed as a permanently fixed image on the surface of the recording material "P" by the fixing apparatus 20. The recording material "P" derived from the fixing apparatus 20 is transported as a full color image formed matter via the transport path 21 by a sheet discharging roller 22 onto a sheet discharging tray 23.

In the secondary transfer portion, the plane of the belt 8 after the recording member is separated is cleaned by removing remaining attached matters such as secondary transfer remaining toners by a belt cleaning apparatus 12 so as to be repeatedly provided for forming images thereon.

In the case where a monochromatic print mode is selected, only the fourth image forming portion Bk for forming a black toner image is controlled based on an image forming operation. In the case where a two-side print mode is selected, a recording material of which first side has already been printed is sent out onto the sheet discharging tray 23 by the sheet discharging roller 22, and at a time instant just before a trailing edge portion passes through the sheet discharging roller 22, the rotation of the sheet discharging roller 22 is reversed. As a result, the recording material is switched back to be introduced into a re-transport path 24. Then, the introduced recording material is brought into a front/back side reversed state, and then, is again transported to the registration roller 16. Subsequently, similar to the image forming operation when the first side is printed, the recording material is transported to the secondary transfer portion and the fixing apparatus 20, and sent out onto the sheet discharging tray 23 as a two-side print image formed product.

(2) Fixing Apparatus 20

In the below-mentioned descriptions, as to either a fixing apparatus or a member which constitutes the fixing apparatus, a longitudinal direction corresponds to such a direction which is located parallel to a direction perpendicular to a transporting direction of a recording material in a transporting path side of the recording material. With respect to the fixing apparatus, a front means a recording material introducing side, whereas a right and a left correspond to a right hand and a left hand of the fixing apparatus as viewed from the front of the fixing apparatus. A width of a recording material corresponds to a dimension of the recording material in a direction perpendicular to the transport direction of the recording material.

Figure 15:
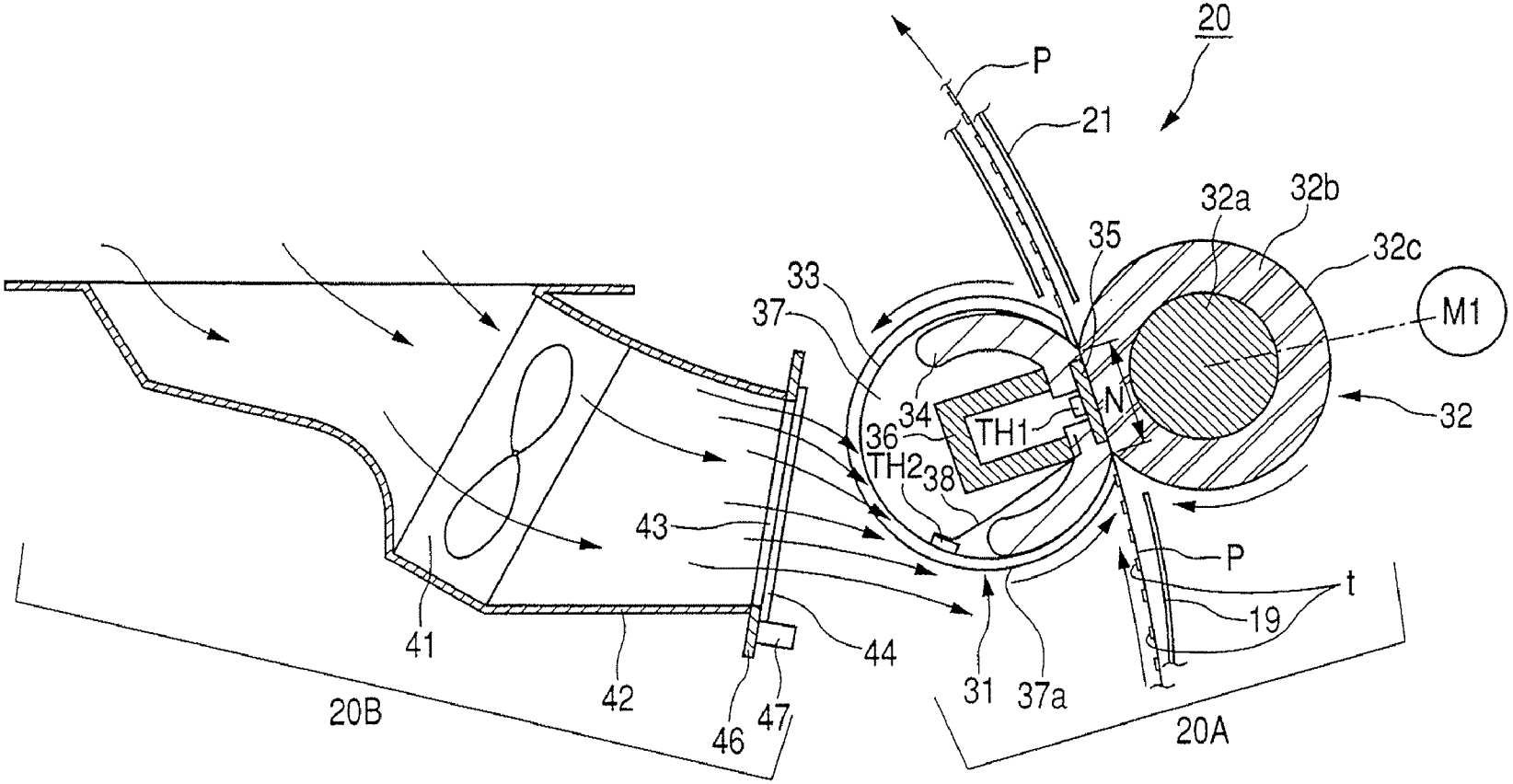
FIG. 15 is a lateral sectional view for schematically indicating an arrangement of a fixing apparatus of an image forming apparatus according to a third embodiment of the present invention.
Figure 17:
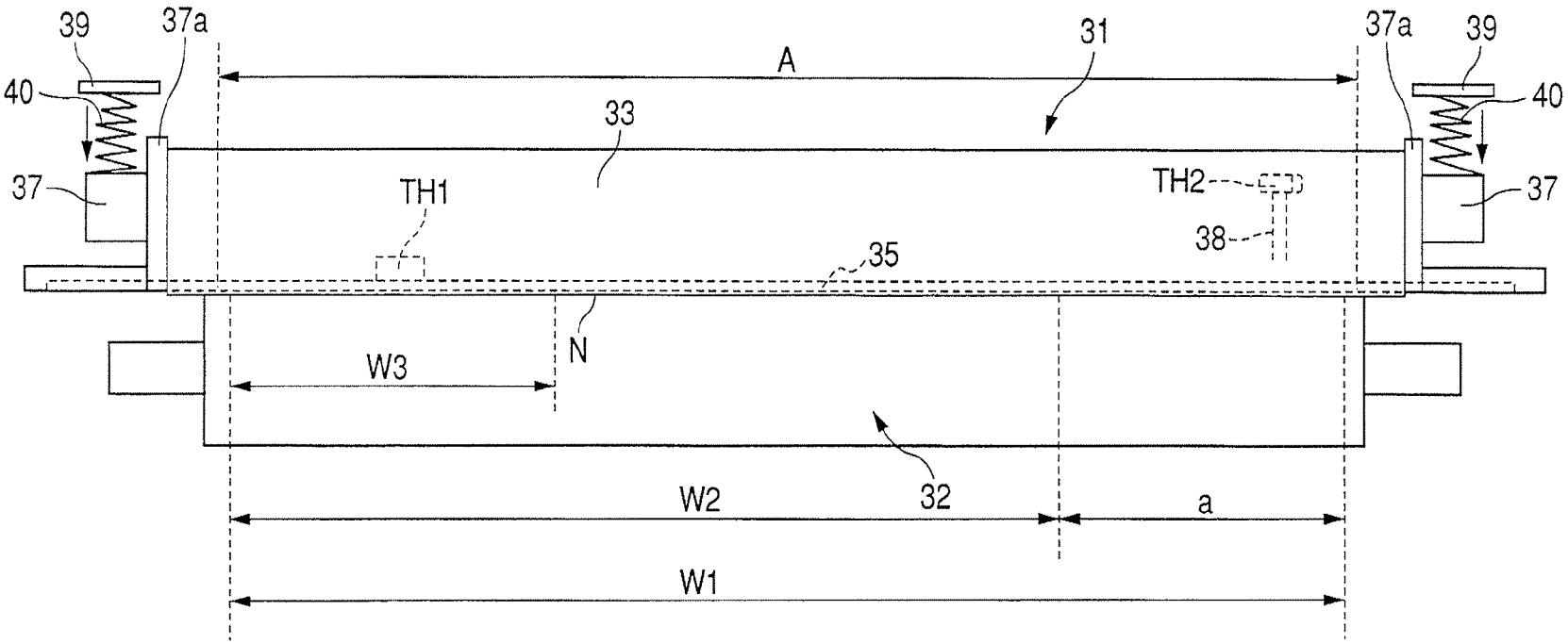
FIG. 17 is a front view for schematically indicating a fixing mechanism portion of the fixing apparatus of FIG. 15.
Figure 18:
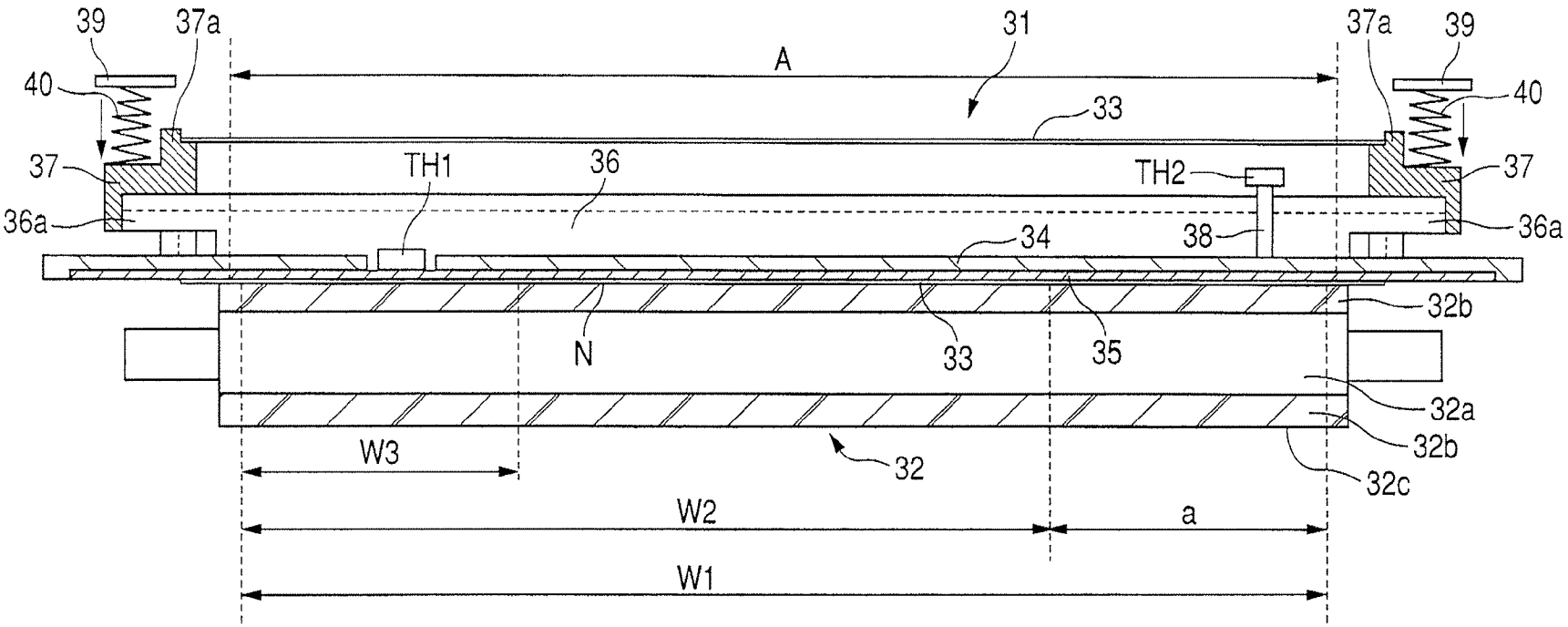
FIG. 18 is a longitudinal sectional frontal view of the fixing mechanism portion shown in FIG. 17.

FIG. 15 is a lateral sectional view for schematically showing an arrangement of the fixing apparatus 20 as an image heating apparatus in the third embodiment. The fixing apparatus 20 mainly comprises a belt (film) heating type fixing mechanism portion 20A and an air blowing cooling mechanism portion (cooling means) 20B. FIG. 17 is a front view for schematically showing the fixing mechanism portion 20A, and FIG. 18 is a longitudinal view for schematically indicating the fixing mechanism portion 20A.

(2-1) Fixing Mechanism Portion 20A

Firstly, an outline of the fixing mechanism portion 20A will now be explained. The fixing mechanism portion 20A basically corresponds to such a belt heating type/pressure rotary member driving type (tensionless type) on-demand fixing apparatus which is disclosed in Japanese Patent Application Laid-Open No. H04-44075 to Japanese Patent Application Laid-Open No. H04-44083, and Japanese Patent Application Laid-Open No. H04-204980 to Japanese Patent Application Laid-Open No. H04-204984.

A belt assembly 31 as a first fixing member (heating member) and an elastic pressure roller 32 as a second fixing member (pressure member) constitute a fixing nip (sheet passing nip) portion "N" by contacting both the belt assembly 31 and the elastic pressure roller 32 with each other under pressure.

The belt assembly 31 contains a cylindrical-shaped fixing belt 33 having a flexibility (fixing film, thin-walled roller: hereinafter, abbreviated as "belt"), a semi-arc trough shaped (as viewed in lateral section) belt guide member 34 (hereinafter, abbreviated as "guide member") having a heat resistance and rigidity, and a ceramics heater 35 (hereinafter, abbreviated as "heater") as a heating source. The fixing belt 33 functions as a heating rotary member. The ceramics heater 35 is arranged in such a way that the ceramics heater 35 is fitted into a concave groove portion formed in an outer surface of the guide member 34 in a longitudinal direction of the guide member 34 and is fixed. The belt 33 is outwardly fitted in a loose manner with respect to the guide member 34 which mounts thereon the heater 35. A U-shaped (as viewed in lateral section) type pressure stay 36 (hereinafter, abbreviated as "stay") having rigidity is arranged inside the guide member 34. An end holder 37 is fitted to be fixed to outwardly projected arm portions 36*a* of right/left end portions of the stay 36. A flange portion 37*a* is formed integrally with the end holder 37.

The pressure roller 32 is such a roller, the hardness of which is reduced by employing an elastic layer 23*b* such silicone rubber on a cored bar 32*a*. In order to improve a surface characteristic, a fluororesin layer 32*c* such as PTFE, PFA, and FEP may be alternatively provided on an outer circumference. The pressure roller 32 is arranged as a pressure rotary member in such a manner that both end portions of the cored bar 32*a* are rotatably held via bearing members between right/left side plates of an apparatus chassis (not shown).

With respect to the above-mentioned pressure roller 32, the belt assembly 31 is arranged in a parallel manner while the heater side thereof is located opposite to the pressure roller 32, and a compression spring 40 is provided between the right/left end portion holders 37 and right/left fixed spring holding members 39 in a compression mode. As a result, the stay 36, the guide member 34, and the heater 35 are depressed and biased to the side of the pressure roller 32. While the depression biasing force is set to a predetermined value, the heater 35 is contacted to the pressure roller 32 by interposing the belt 33 under pressure against the elasticity of the elastic layer 32*b*, so the fixing nip portion "N" having a predetermined width is formed between the belt 33 and the pressure roller 32 in the transporting direction of the recording material.

Figure 19:
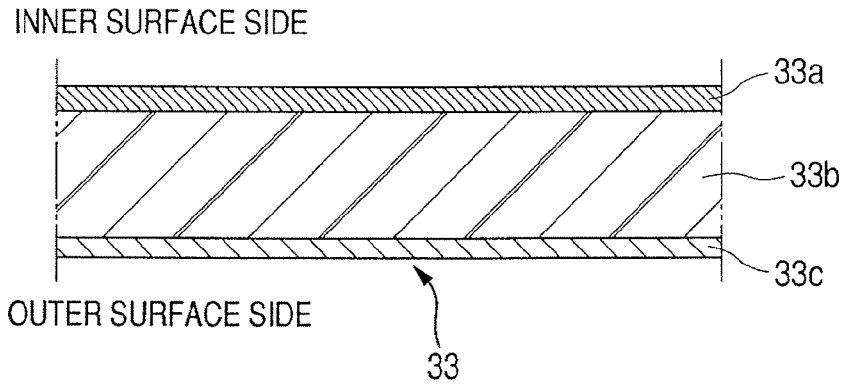
FIG. 19 is a schematic diagram for showing a layer structure of a fixing belt.

As indicated in a layer structural schematic diagram of FIG. 19, the belt 33 employed in the third embodiment has a trilaminar structure constructed of a base layer 33*a*, an elastic layer 33*b*, and a releasing layer 33*c* in this order from an inner surface side to an outer surface side. As to the base layer 33*a*, in order to improve a quick starting characteristic by reducing a heat capacity, a heat resisting belt having a thickness smaller than, or equal to 100 μm, preferably such a thickness smaller than, or equal 50 μm, and larger than, or equal to 20 μm may be employed. For instance, belts made of polyimide, polyimideamide, PEEK, PES, PPS, PTFE, PFA, and FEP may be used. In this example, a cylindrical-shape polyimide belt having a diameter of 25 mm is employed. As to the elastic layer 33*b*, such a silicone rubber is employed, the rubber hardness of which is 10 degrees (JIS-A), the heat conductivity of which is $4.18605\times10^{-1}$ W/m·degree ($1\times10^{-3}$ [cal/cm.sec.deg]) and the thickness of which is 200 μm. As to the releasing layer 33*c*, a PFA coat layer having a thickness of 20 μm is employed. Alternatively a PFA tube may be employed. A PFA coat has the following superior points, as compared with a PFA tube: That is, a thickness of the PFA coat can be made thinner, and a toner wrapping effect is stronger in view of a material aspect. In other words, because both a mechanical strength and an electric strength of a PFA tube become superior, as compared with those of a PFA coat, these PFA tube and PFA coat may be selectively used.

Figure 20:
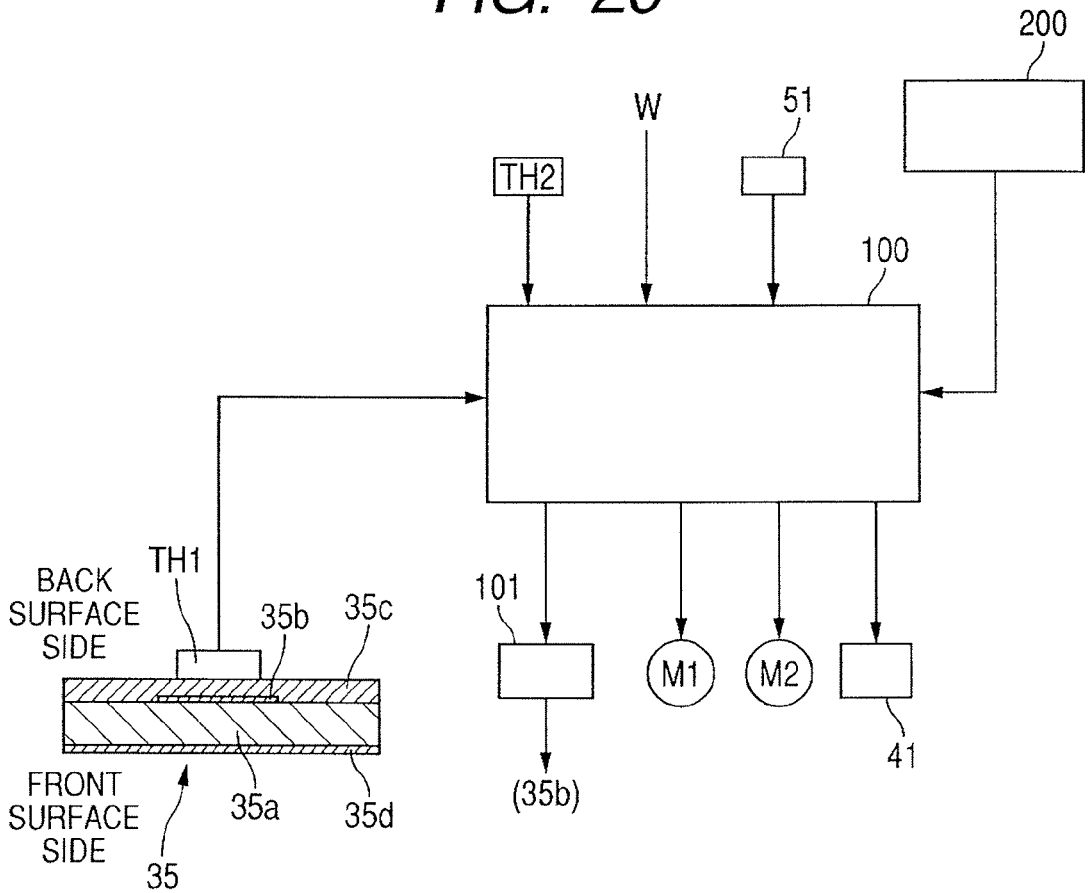
FIG. 20 is a lateral sectional view for schematically indicating a heater and a block diagram of a control system.

The heater 35 in the third embodiment corresponds to a back surface heating type heater with employment of aluminum nitride, or the like as a heater board, and corresponds to a line-shaped heating member having a low heat capacity. A lateral edge of the line-shaped heating member is longer, and a longitudinal edge thereof is coincident with a direction perpendicular to the transporting direction of the fixing belt 33 and the recording material "P". FIG. 20 is a lateral sectional view for schematically showing the heater 35 and a control system diagram of the heater 35. The heater 35 contains a heater board 35*a* made of aluminum nitride, or the like. An energizing heating layer 35*b* is provided on the back surface side (namely, such a surface side opposite to fixing belt opposing surface side) of the heater board 35*a* by coating an electric resistance material in the longitudinal direction. The electric resistance material is made of, for instance, Ag/Pd (argentine/palladium), or the like, and has a length of approximately 10 μm, and a width of 1 to 5 mm by way of a screen printing operation etc. Furthermore, the back surface side of the heater board 35*a* has a protection layer 35*c* which is made of glass, or fluororesin and is formed on the energizing heating layer 35*b*. In the third embodiment, a sliding member (lubricant member) 35*d* is provided on the front surface side (namely, belt opposing surface side) of the heater board 35*a*.

The heater 35 is fitted into a groove portion so as to be fixed and supported therein in such a manner that the front surface side of the heater board 35*a* where the sliding member 35*d* is formed is exposed. The groove portion is formed in the guide longitudinal direction at a substantially center portion of the outer surface of the guide member 34. In the fixing nip portion "N", a surface of the sliding member 35*d* of the heater 35 and an inner surface of the belt 33 are contacted to each other and are slid with each other. Then, the belt 33 corresponding to the rotating image heating member is heated by the heater 35.

Because both longitudinal end portions of the energizing heating layer 35*b* of the heater 35 are energized, the energizing heating layer 35*b* is heated, so a temperature of the heater 35 is rapidly increased over an entire area of an effective heating width "A" thereof in the heater longitudinal direction. The heater temperature is detected by a first temperature sensor (first temperature detecting means: center temperature sensor) TH1 such as a thermistor, and then, an output (signal value related to heater temperature) is inputted via an A/D converter to a control circuit portion 100, while the first temperature detecting means TH1 is arranged by being contacted to the outer surface of the heater protection layer 35*c*. The control circuit portion 100 controls an energizing operation from a power supply (power supplying unit, and heater driving circuit unit) 101 with respect to the energizing heating layer 35*b* based on the detected temperature information to be inputted in such a manner that the heater temperature is maintained at a predetermined temperature. In other words, the temperature of the belt 33 corresponding to the image heating member heated by the heater 35 is controlled to become a predetermined fixing temperature based on the output value of the first temperature sensor TH1.

Figure 21:
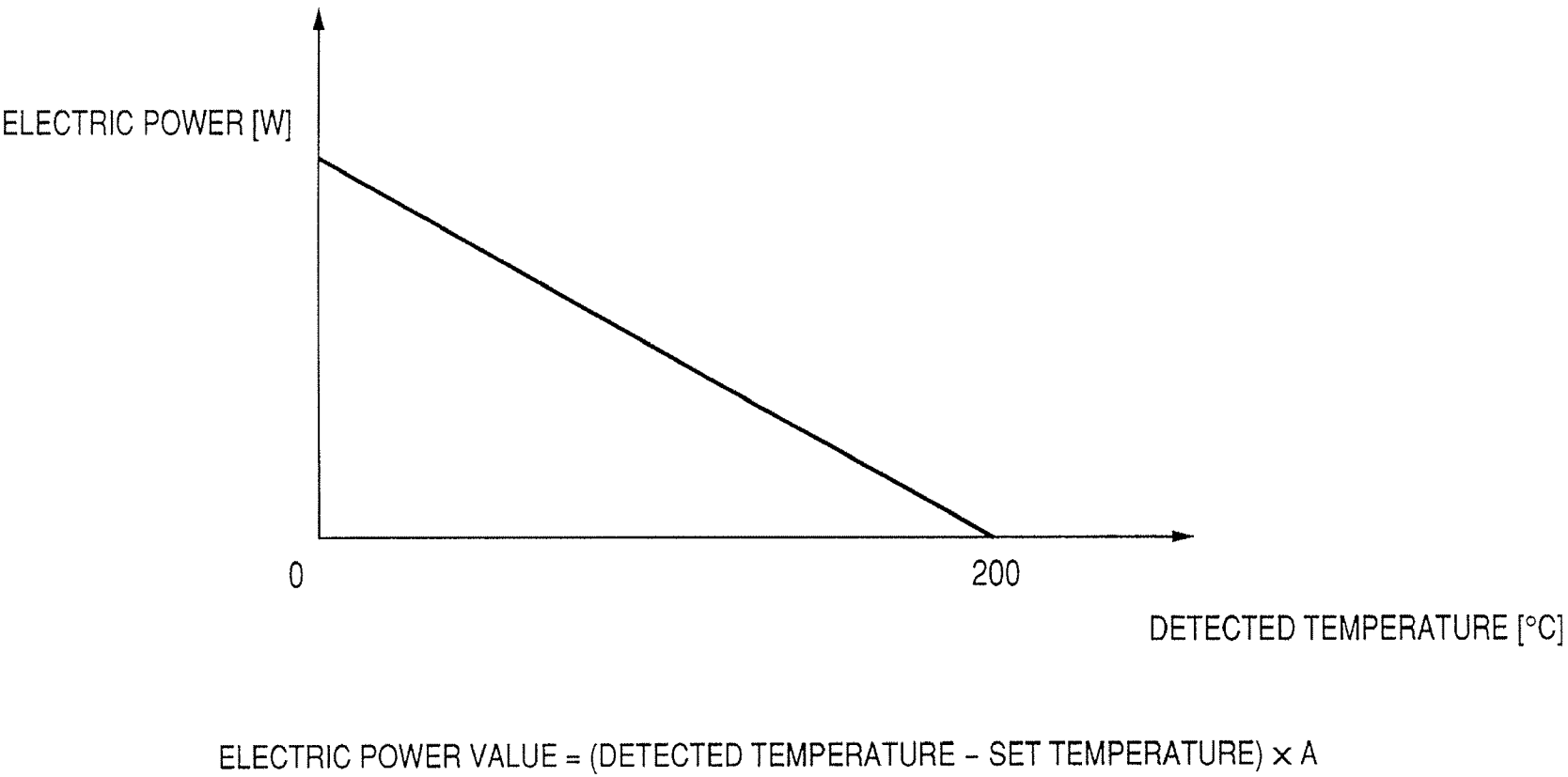
FIG. 21 is an explanatory diagram for explaining a temperature control method.

The third embodiment is set to such a system that a proportional control system is employed as the temperature control system, and such an electric power proportional to deviation between the setting value (220 degrees in embodiment 3) of the heater temperature, as shown in, for example, FIG. 21, and the temperature measured by the first temperature sensor TH1 is applied to the heater 35.

The pressure roller 32 is rotary driven by a motor (driving means) M1 in a counterclockwise direction indicate by an arrow. A rotation force is exerted to the belt 33 by a friction force produced in the fixing nip portion "N" between the pressure roller 32 rotated by the pressure roller 32 and the outer surface of the belt 33. As a result, while the belt 33 is slid by close-contacting the inner surface of the belt 33 to the heater 35 in the fixing nip portion "N", the belt 33 is outwardly rotated around the guide member 34 in the counterclockwise direction indicated by the arrow (pressure roller driving system). The belt 33 is rotated at a circumferential speed nearly equal to the rotating circumferential speed of the pressure roller 32. The right and left flange portions 37*a* play a role of restricting a biased movement when the rotating belt 33 is moved by being biased to either a left hand or a right hand in the longitudinal direction of the guide member 34 in such a manner that the right and left flange portions 37*a* accept such a belt end portion of the biased movement. In order to reduce the mutual sliding friction force between the heater 35 and the inner surface of the belt 33 in the fixing nip portion "N", a sliding member 35*d* is arranged on the heater surface of the fixing nip portion "N", and a lubricant agent such as heat resisting grease is interposed between the inner surface of the belt 33 and the heater 35.

Then, based on a print starting signal, a rotation of the pressure roller 32 is started, and a heat-up operation of the heater 35 is commenced. Under such a condition that the rotation circumferential speed of the belt 33 becomes the steady speed, and the temperature of the heater 35 or the temperature of the belt 33 rises to a predetermined temperature, the recording material "P" on which a toner image "t" is carried is introduced into the fixing nip portion "N" in such a manner that the toner image carrying surface of the recording material "P" is located on the side of the belt 33. The recording material "P" is close contacted to the heater 35 via the belt 33 in the fixing nip portion "N", and is moved to pass the fixing nip portion "N" in combination with the belt 33. In the course of the movement pass, the heat is applied to the recording material "P" by the belt 33 heated by the heater 35, so the toner image "t" is heated so as to be fixed on the surface of the recording material "P". The recording material "P" which passes through the fixing nip portion "N" is separated from the surface of the belt 33, and then, is discharged and transported.

In the third embodiment, the transportation of the recording material "P" is performed based on a so-called "one side reference transportation." Symbol "S" indicates a central sheet-passing reference line (virtual line) of the relevant recording material.

Symbol "W1" denotes a sheet-passing width (maximum sheet-passing width) of a maximum width recording material which can pass through the image forming apparatus. In the third embodiment, the maximum sheet-passing width "W1" corresponds to an A4-size width 297 mm (A4 landscape feed). The effective heating area width "A" of the heater longitudinal direction is set to be slightly wider than the maximum sheet-passing width "W1."

Symbol "W3" denotes a sheet-passing width (minimum sheet-passing width) of a minimum width recording material which can pass through the image forming apparatus. In the third embodiment, the minimum sheet-passing width "W3" corresponds to a postcard portrait passing width 100 mm.

Symbol "W2" corresponds to a sheet-passing width of such a recording material having a width between the maximum width recording material and the minimum width recording material. In this drawing, the sheet-passing width "W2" represents an A4 portrait feed width (A5 landscape feed width) 210 mm.

In the below-mentioned description, a recording material having a width size corresponding to the maximum sheet-passing width "W1" will be referred to as a maximum size width recording material, and another recording material having a width narrower than the maximum sheet-passing width "W1" will be referred to as a small-size-width recording material.

Symbol "a" shows a difference width portion (W1−W2) between the maximum sheet-passing width "W1" and the sheet-passing width "W2". In other words, the difference width portion is a non-sheet passing portion, which is produced when the small-size-width recording material is passed. The widths of these non-sheet passing portions "a" are different from each other, depending on wider/narrower widths of small-size-width recording materials, which are normally used.

The first temperature sensor TH1 is arranged in such a manner that the first temperature sensor TH1 detects a heater temperature (=sheet-passing portion temperature) of a portion corresponding to the minimum sheet-passing width "W3".

Symbol "TH2" indicates a second temperature sensor (second temperature detecting means: sub-temperature sensor) such as a thermistor. The second temperature sensor TH2 is arranged in such a manner that the second temperature sensor TH2 detects a temperature of the fixing belt 33 of the non-sheet passing portion when the small-size-width recording material is passed. A sensor output (signal value related to temperature) is inputted via the A/D converter to the control circuit portion 100. In the third embodiment, the second temperature sensor TH2 is arranged in such a manner that at a position separated from the recording material one side sheet-passing reference line S by 290 mm, the second temperature sensor TH2 is elastically contacted to an inner surface of the basic layer of the fixing belt portion. Concretely speaking, the second temperature sensor TH is arranged at a free end of an elastic supporting member 38 having a leaf spring shape, the base portion of which is fixed to the guide member 34. Then, the second temperature sensor TH2 elastically abuts against the inner surface of the base layer 33*a* of the belt 33 due to elasticity of the elastic supporting member 38 so as to detect a temperature of the belt portion.

It should also be noted that the first temperature sensor TH1 may be alternatively and elastically contacted to the base layer inner surface of the belt portion corresponding to the sheet-passing portion "W3". Both the first and second temperature sensors TH1 and TH2 may be alternatively arranged so as to detect heater temperatures.

(2-2) Air Blowing Cooling Mechanism Portion 20B

Figure 22:
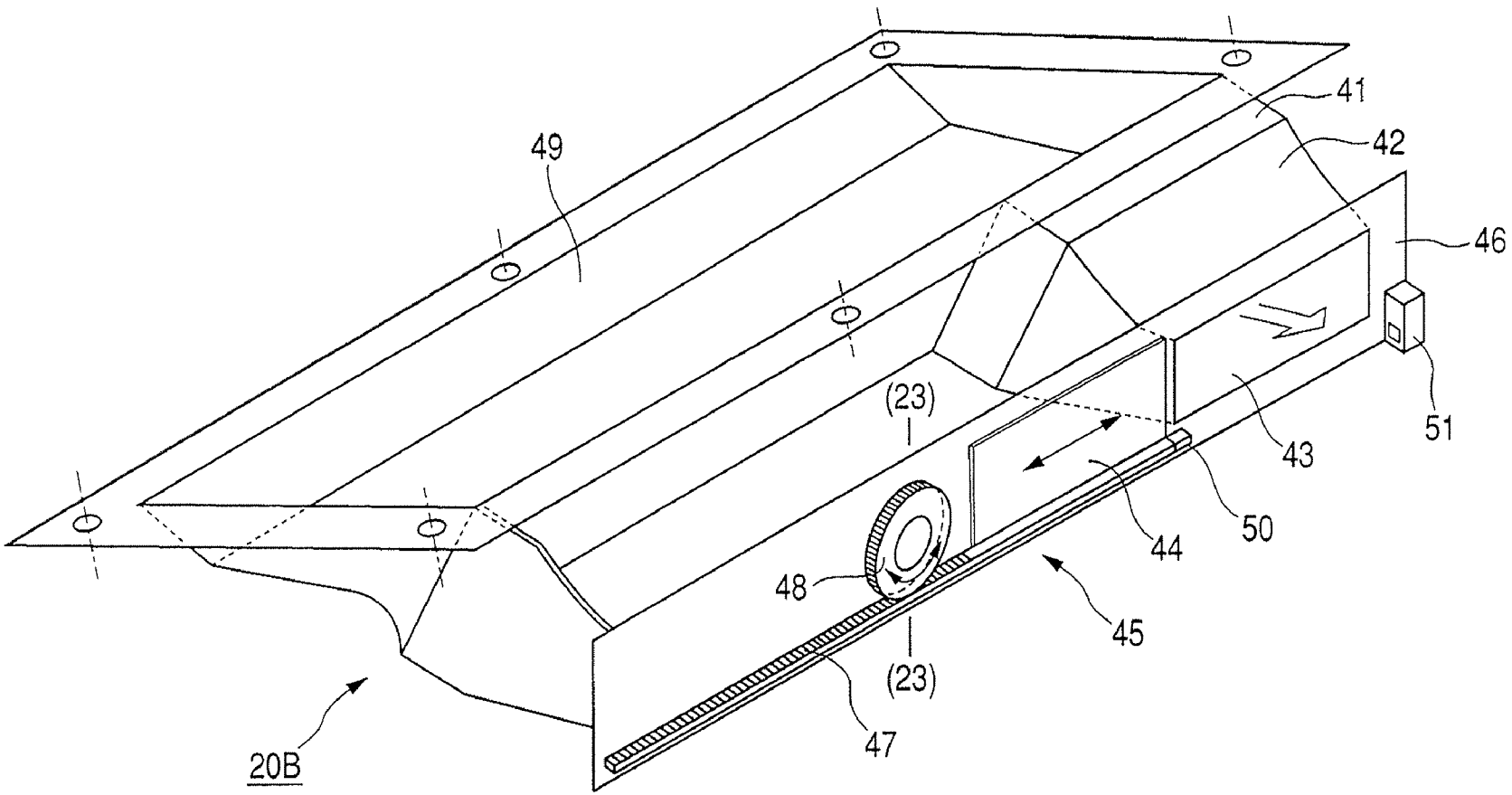
FIG. 22 is a perspective view for schematically showing an outer view of an air blowing cooling mechanism portion.
Figure 23:
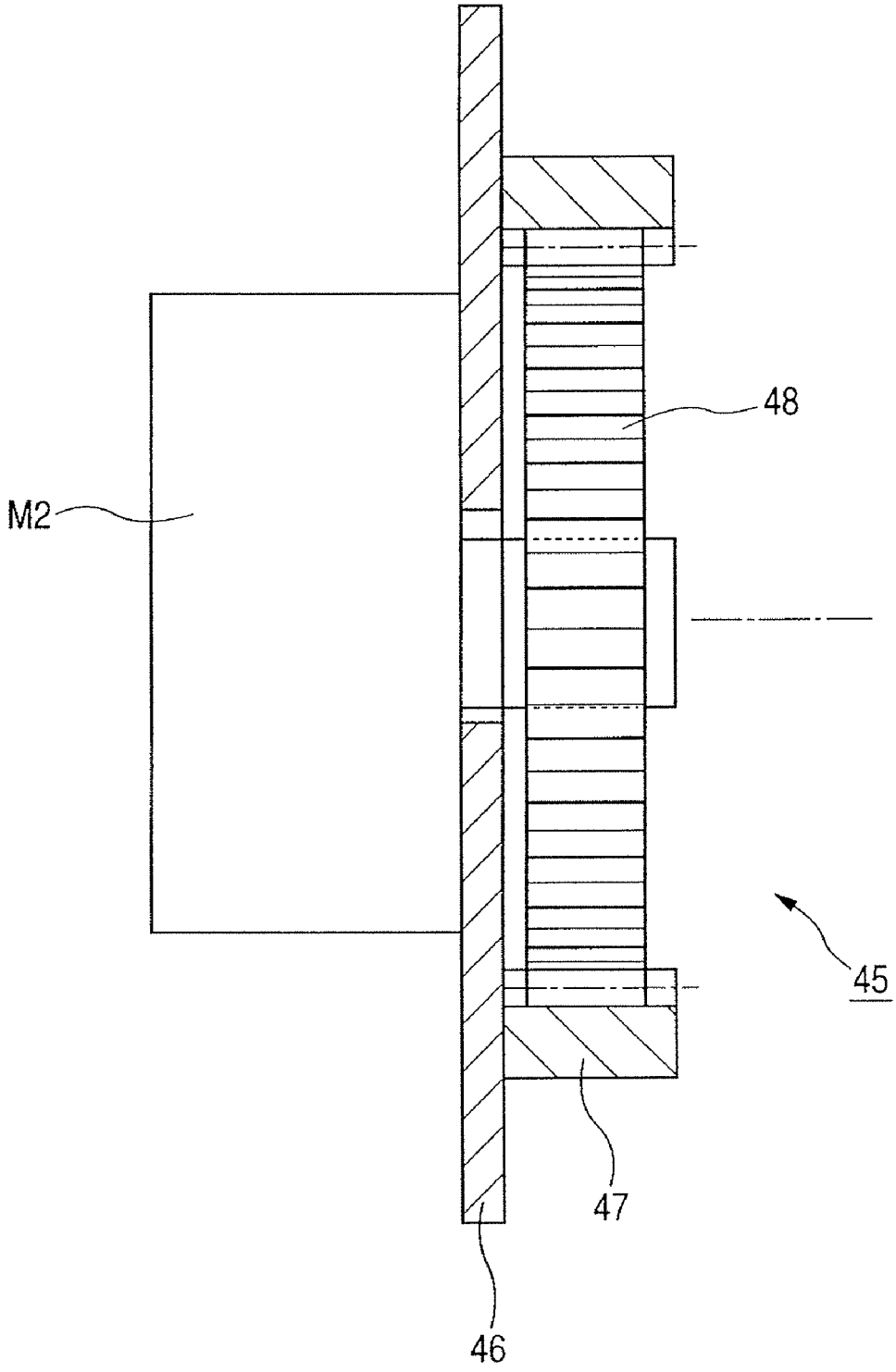
FIG. 23 is an enlarged sectional view for showing the air blowing cooling mechanism portion, take along a line (23)-(23) of FIG. 22.

The air blowing cooling mechanism portion 20B is such cooling means for cooling a temperature rise of the non-sheet passing portion of the fixing mechanism portion 20A by blowing air, which occurs when a small-size-width recording material is continuously passed (small size job). FIG. 22 is a perspective view for schematically showing an outer view of the air blowing cooling mechanism portion 20B. FIG. 23 is an enlarged sectional view of the air blowing cooling mechanism portion 20B, taken along the line (23)-(23) of FIG. 22.

Referring now to FIG. 15, FIG. 22, and FIG. 23, a description is provided of the air blowing cooling mechanism portion 20B according to the third embodiment. The air blowing cooling mechanism 20B contains an air blowing (cooling) fan (hereinafter, abbreviated as "fan") 41, an air blowing duct 42, and an air blowing ports (duct opening portion) 43. The air blowing duct 42 conducts air produced by the fan 41. The air blowing ports 43 are arranged at a portion of the air blowing duct 42, which is located opposite to the fixing mechanism portion 20A. Also, the air blowing cooling mechanism portion 20B contains a shutter (closure plate) 44, and a shutter driving apparatus (air blowing port width adjusting apparatus) 45. The shutters 44 adjust an opening width (namely, length in width direction) of the air blowing ports 43 to be a width which is suitable for a width of a recording material to be passed. The shutter driving apparatus 45 drives the shutters 44. Reference numeral 49 indicates an air intake channel portion arranged on the air intake side of the fan 41. As the above-mentioned fan 41, a centrifugal fan such as a sirocco fan may be used.

The shutters 44 are supported slidably in the right/left directions along a plate surface of the supporting plate 46 which is extended in the right/left directions, in which the air blowing ports 43 are formed. The shutters 44 are communicated with each other by employing a rack teeth 47 and a pinion gear 48, and the pinion gear 48 is driven by a motor (pulse motor) M2 in a normal rotation direction, or a reverse rotation direction. As a result, the shutters 44 may be opened and closed with respect to the air blowing ports 43. The shutter driving apparatus 45 is arranged by the above-mentioned supporting plate 46, rack teeth 47, pinion gear 48, and motor M2.

In the third embodiment, the opening width of the air blowing ports 43 correspond to the width of the non-sheet passing portion "a" produced when an A4-sized recording material is longitudinally fed as the small-size-width recording material.

Width information W (FIG. 20) of a recording material is inputted into the control circuit portion 100, while the recording material is passed based on an input of a used recording material size by a user, and information acquired by an automatic recording material width detecting mechanism (not shown) as to the sheet feeding cassette 13 and the manual sheet feeding tray 17. Then the control circuit portion 100 controls the shutter driving apparatus 45 based on the width information W. In other words, the motor M2 is driven so as to rotate the pinion gear 48 and move the shutters 44 by the rack teeth 47, so the air blowing ports 43 can be opened by a predetermined amount.

Figure 24:
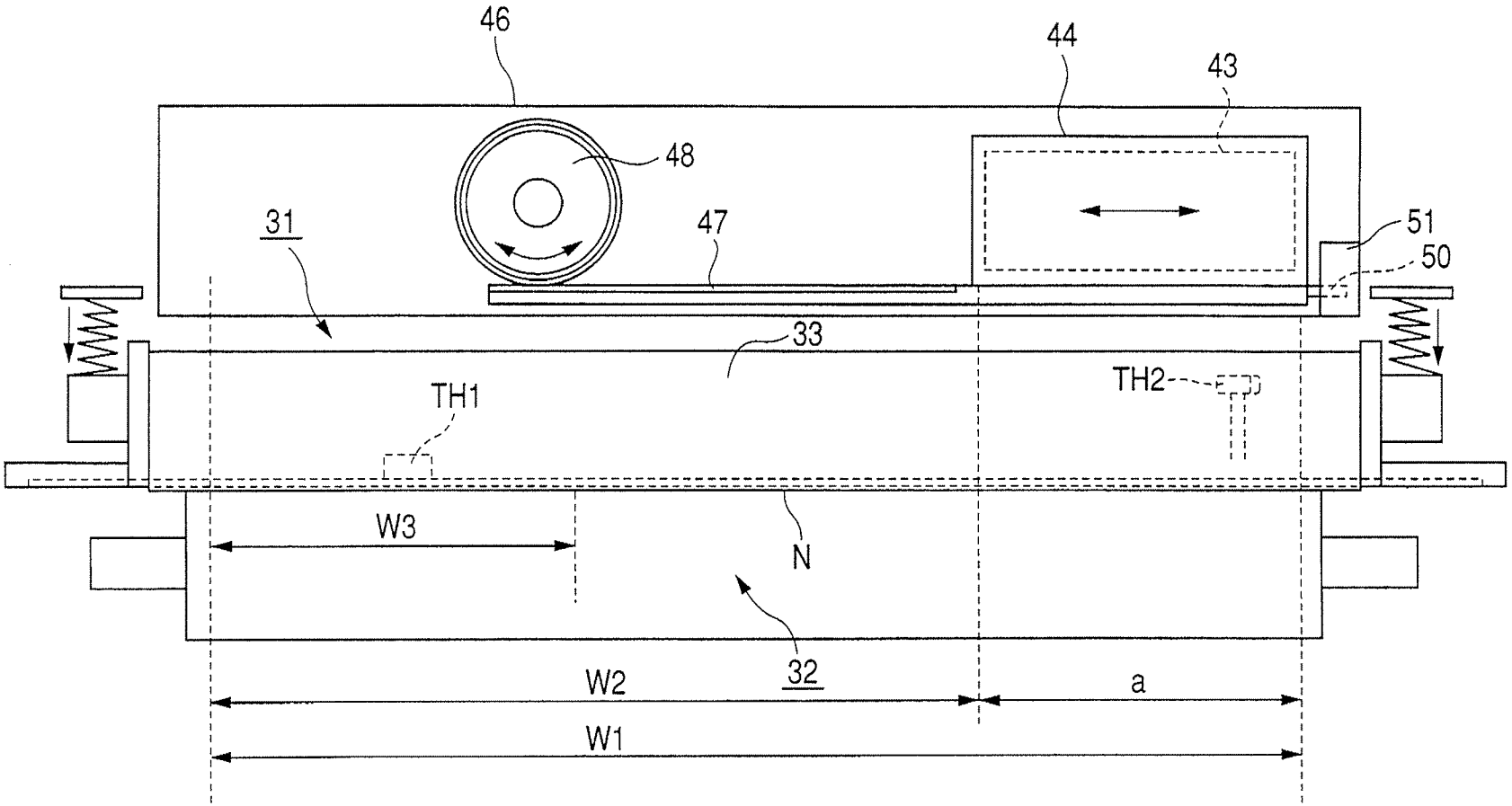
FIG. 24 is a status diagram for showing such a status that the shutter is moved to a fully closed position where the shutter has fully closed a ventilation port.
Figure 25:
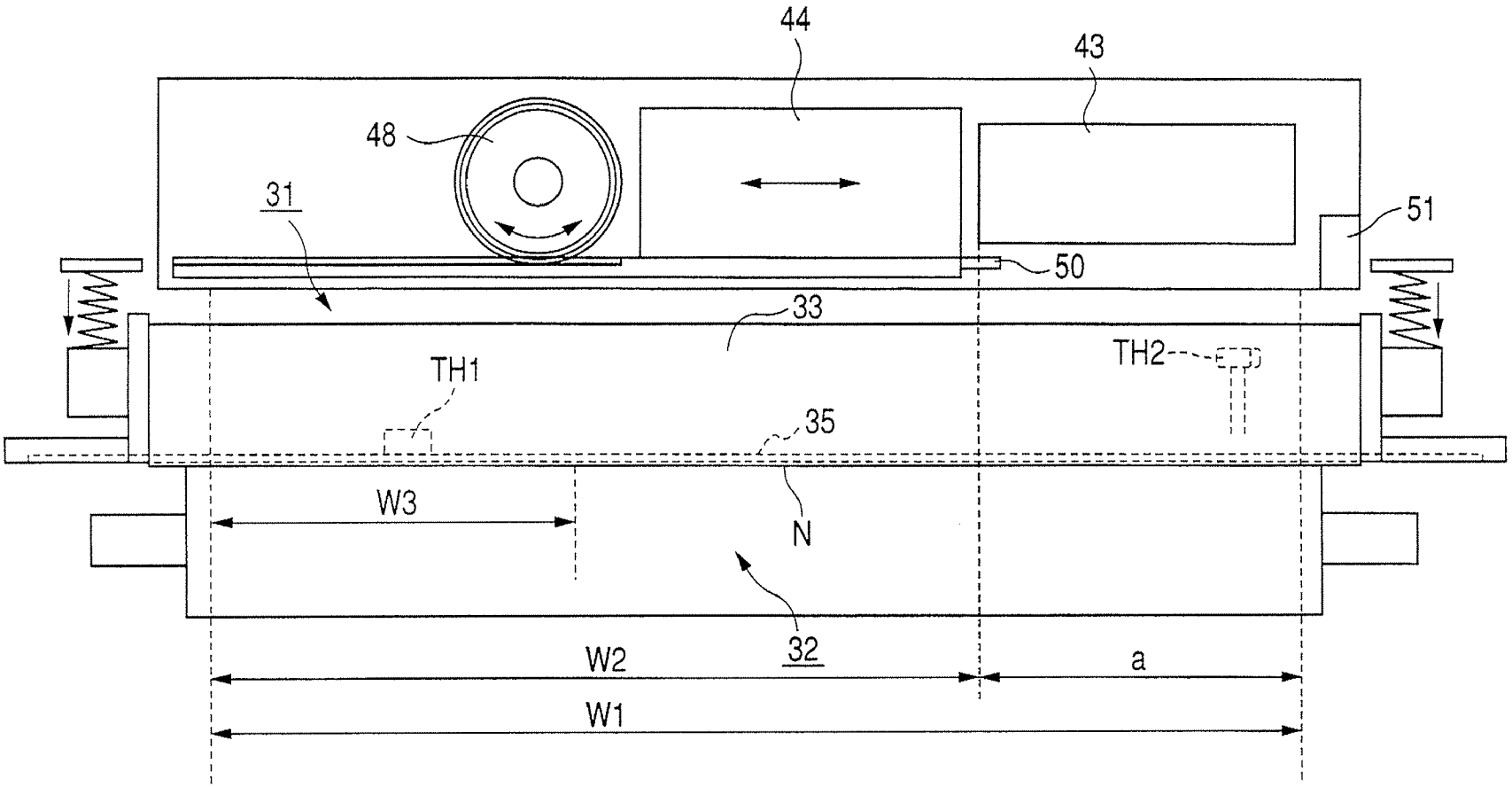
FIG. 25 is a status diagram for showing such a status that the shutter is moved to a fully opened position where the shutter has fully opened the ventilation port.

When the width information W of the recording material is the maximum size recording material (A4 landscape), the control circuit portion 100 controls the shutter driving apparatus 45 so as to move the shutters 44 to a fully closed position where the air blowing port 43 are completely closed as shown in FIG. 24. When the width information W of the recording material is the small-size-width recording material of an A4 portrait size width, the control circuit portion 100 controls the shutter driving apparatus 45 so as to move the shutters 44 to a fully opened position where the air blowing ports 43 is completely opened, as indicated in FIG. 25. Further, when the width information W of the recording material is width sizes of such recording materials between the maximum size width and the small-size-width, namely, a letter landscape (279.4 mm), a B4 portrait/B5 landscape (257 mm), a letter portrait/legal portrait (215.9 mm), and the like, the control circuit portion 100 controls the shutter driving apparatus 45 so as to move the shutters 44 to such a position where the air blowing ports 43 are opened only by a portion corresponding to a non-sheet passing portion produced by each of these recording materials.

It should be understood that the minimum, maximum, and full recording material sizes in the third embodiment imply paper specifications guaranteed by the image forming apparatus main body, but do not imply indefinite size paper which is originally used by the user.

The positional information of the shutters 44 is detected by a sensor 51 which is arranged on the supporting plate 46 for supporting a flag 50 arranged at a predetermined position of the shutters 44. Concretely speaking, as indicated in FIG. 24, while a home position is determined at a shutter position where the duct opening portion 43 is fully closed, an opening amount is detected from a rotation amount of the motor M2.

Alternatively, while such an opening width sensor for directly detecting present positions of the shutters 44 may be equipped, shutter positional information detected by the opening width detection sensor may be fed back to the control circuit portion 100 so as to move the shutters 44 to proper opening width positions in correspondence with a width of a recording material to be passed. As to the stopping positions of the shutters 44, because edge positions of the shutters 44 are detected by a sensor, such a position corresponding to the length of the small size recording material in the width direction may be determined with higher precision. As a consequence, the cooling wind may be blown only with respect to the non-sheet passing portion of the full small size recording material.

(2-3) Control Sequence of Image Heating Mechanism Portion 20A

A first description is made of a hot offset, which is produced in the case where a small-size-width recording material is passed in a continuous manner. FIG. 26C is a diagram for explaining a temperature transition of a surface of the fixing belt 33 when an A4 portrait paper is continuously passed as the small-size-width recording material. As represented in FIG. 27, as to temperature measurement points A, B, and C, the measurement point "A" indicates a portion in the vicinity of a sheet passing area center; the measurement point "B" shows a portion in the vicinity of the second temperature sensor TH2 for detecting a temperature of a non-sheet passing portion; and the measurement point "C" represents a sheet passing area end portion.

When an image forming operation of the image forming apparatus is commenced, at the substantially same time, an operation of energizing the heater 35 is commenced, so the heat generating layer 35*b* generates heat, and thus, both the fixing belt 33 and the pressure roller 32 are heated. When a signal value detected by the first temperature sensor TH1 becomes equal to a predetermined signal value, in the third embodiment, becomes such a signal value equivalent to 220 degrees, the temperature of the heater 35 is maintained at nearly 220 degrees by way of the above-mentioned proportional control system.

After the lapse of a predetermined time (T1) since the energizing operation to the heater 35 was commenced (indicated by "0" second in FIG. 26A to FIG. 26C), a sheet passing operation of the A4 portrait recording material which carries thereon an unfixed toner image is commenced. At this time, temperatures of the surface of the fixing belt 33 are substantially equal to 175 degrees at the measurement points A, B, C.

While the recording material is passed, at the point A of the sheet passing area, such a condition is established under which a removed heat amount by the recording material is balanced with a heating amount from the heater 35, the temperature of the surface of the fixing belt 33 becomes constant at substantially 175 degrees, although ripples of approximately several degrees are produced.

However, a temperature of the surface of the fixing belt 33 at the point B of the non-sheet passing area where the heat removed by the recording material is not produced is increased up to approximately 210 degrees. Because the heat amount of the non-sheet passing area is moved, a temperature of the surface of the fixing belt 33 at the point C of the sheet passing area end portion is increased up to 195 degrees. At this portion, a hot offset occurs. The hot offset occurs, because viscosity of a toner is considerably lowered in such a case where the temperature of the surface of the fixing belt 33 is higher than, equal to 190 degrees.

Next, a description is made of control sequences of the image heating mechanism portion 20A after a small-size-width recording material is continuously passed, which corresponds to a featured portion of the third embodiment.

That is, in the control sequences, the below-mentioned first control mode and second control mode are used in a distinguishable manner.

The first control mode is capable of preventing a hot offset and lowering of productivity by blowing cooling wind to the non-sheet passing area based on a size of a small-size-width recording material in a width direction. In other words, in the case where a width of a recording material is defined within a predetermined range, an image forming operation is carried out in combination of a cooling operation.

The second control mode is capable of prevent a hot offset by decreasing a temperature of the non-sheet passing area by way of a throughput down control operation, although productivity is lowered. In other words, in such a case where a width of a recording material is defined within the predetermined width, an image forming operation is carried out by executing the throughput down control operation, while the cooling operation is not carried out.

In this case, the above-mentioned throughput down control operation corresponds to such a control operation for performing an image forming operation in which a total number of recording materials per unit time is reduced which pass through the fixing nip portion "N". Concretely speaking, the below-mentioned control methods "a", "b", "c" are provided.

The control method "a": Because the interval between recording materials which pass through the fixing apparatus (image heating means) is increased, a temperature of the non-sheet passing area temperature is lowered.

The control method "b": While the interval between recording materials which pass through the fixing apparatus (image heating means) is increased, a temperature of the non-sheet passing area temperature is lowered by stopping a heating operation when a recording material does not pass through a fixing area.

The control method "c": A discharging speed of a recording material by the fixing apparatus is decreased.

Figure 13:
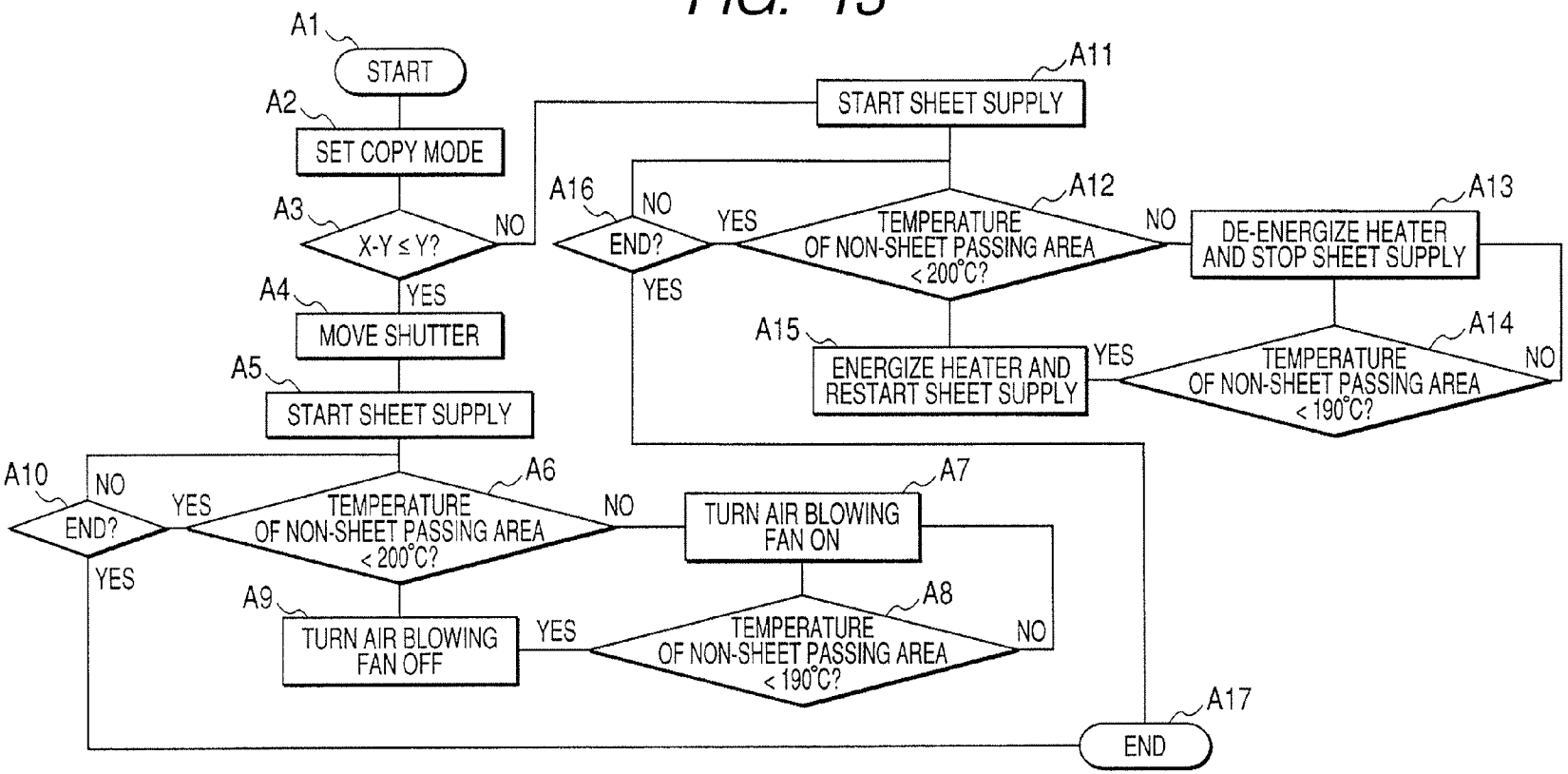
FIG. 13 is a flow chart for explaining a control sequence of a fixing apparatus (image heating apparatus) of an image forming apparatus according to a third embodiment of the present invention.

FIG. 13 is a flow chart for describing control sequential operations of the image heating mechanism 20A after small-size-width recording materials are passed in a continuous manner.

1). In such a case where a width direction size of a recording material which is passed and used from set sizes of a copy mode satisfies such a relationship [$X-Y \leqq Y$]:

In the third embodiment, in the case where a small-size-width recording material to be passed is an A4 portrait paper, as shown in FIG. 25, the width of the air blowing ports 43 are adjusted to be an area corresponding to a non-sheet passing area of the A4 portrait paper by moving the shutter 43 (step A4), and thereafter, a sheet supply operation is commenced (step A5).

When a detected temperature of the second temperature sensor TH2 which detects the temperature of the non-sheet passing area is increased up to 200 degrees (=air blowing starting temperature) (step A6), the air blowing fan 41 is immediately turned ON (step A7) so as to blow cooling wind to the non-sheet passing area of the A4 portrait size, namely, air blowing cooling operation is carried out.

Then, the temperature of the non-sheet passing area becomes lower than, or equal to 190 degrees (step A8), and thereafter, the air blowing fan 41 is turned OFF (step A9).

Also, while the A4 portrait paper is subsequently passed, the air blowing fan 41 is turned ON/OFF based on a detected temperature of the second temperature sensor TH2.

In other words, in the case where the width of the recording material to be passed is defined with the predetermined (X−Y≦Y), the opening width of the air blowing ports 43 are adjusted based on the size of the recording material to be passed by operating the shutter driving apparatus 45, and the ON/OFF control operation of the air blowing fan 41 is carried out based on the temperature of the non-sheet passing portion of the belt 33.

In this case, with respect to recording materials having substantially all of width direction sizes, which are generally employed, both the hot offset and lowering of the productivity can be prevented at the same time.

2). In such a case where a width direction size of a recording material which is passed and used from set sizes of a copy mode satisfies such a relationship [X−Y>Y]:

In the third embodiment, in the case where a small-size-width recording material to be passed is a postcard portrait, a sheet supply operation is commenced while the shutter 41 is not moved (step A11).

When a detected temperature of the second temperature sensor TH2 which detects the temperature of the non-sheet passing area is increased up to 200 degrees (step A12), the throughput down control operation is immediately carried out. In the third embodiment, both the sheet supply operation and the energizing operation to the heater 35 are stopped so as to perform a heat dissipation cooling operation of the non-sheet passing area (step A13).

When the detected temperature of the second temperature sensor TH2 becomes 190 degrees (step A14), an operation of energizing the heater 35 is carried out, and after the detected temperature of the first temperature sensor TH1 reaches to 220 degrees, the sheet supply operation is restarted.

Also, while the postcard is subsequently passed, As described above, the energizing operation to the heater 35 and the sheet supply operation are turned ON/OFF based on a detected temperature of the second temperature sensor TH2. In this case, although productivity is lowered, the hot offset can be prevented.

This is to say, in the case where the width of the recording material to be passed is within the predetermined range (X−Y>Y), while the cooling operation is not carried out, such an image forming operation is carried out in which a total number of recording materials per unit time is reduced which pass through the nip portion.

In the image forming apparatus, because there is a very rare case where the recording materials having these width direction sizes are employed, there is a very low possibility that lowering of the above-mentioned productivity occurs. As a consequence, there is a only very small stress given to the user with respect to lowering of the productivity, which is not comparable with the stresses of the user as to bulky and high cost aspects of the image forming apparatus.

Figure 26A:
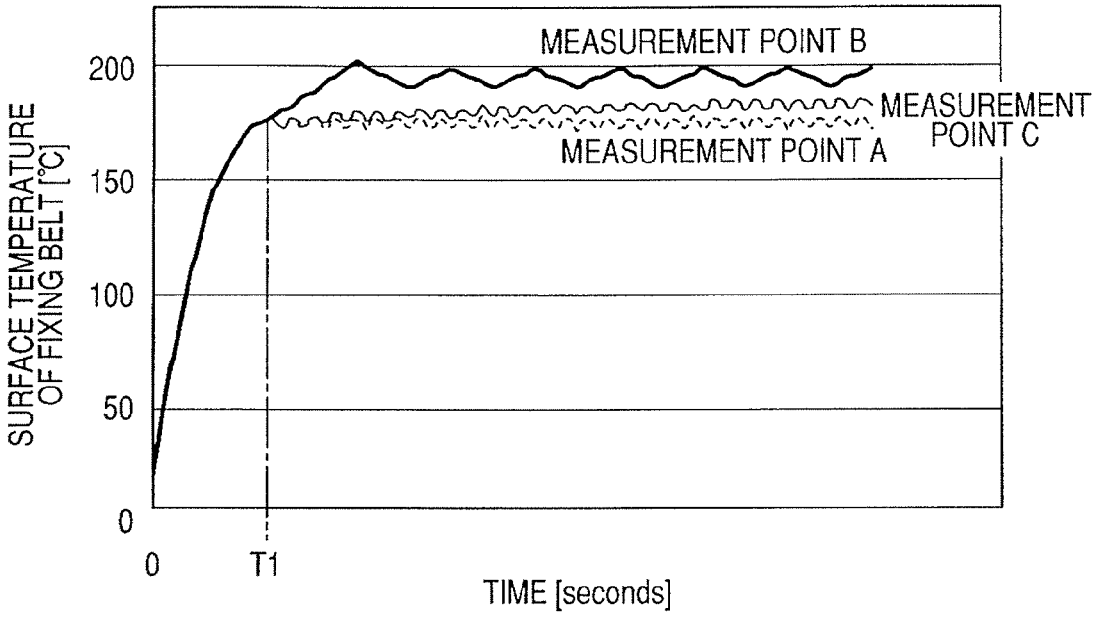
FIG. 26A is an explanatory diagram for explaining a temperature transition (No. 1).
Figure 26B:
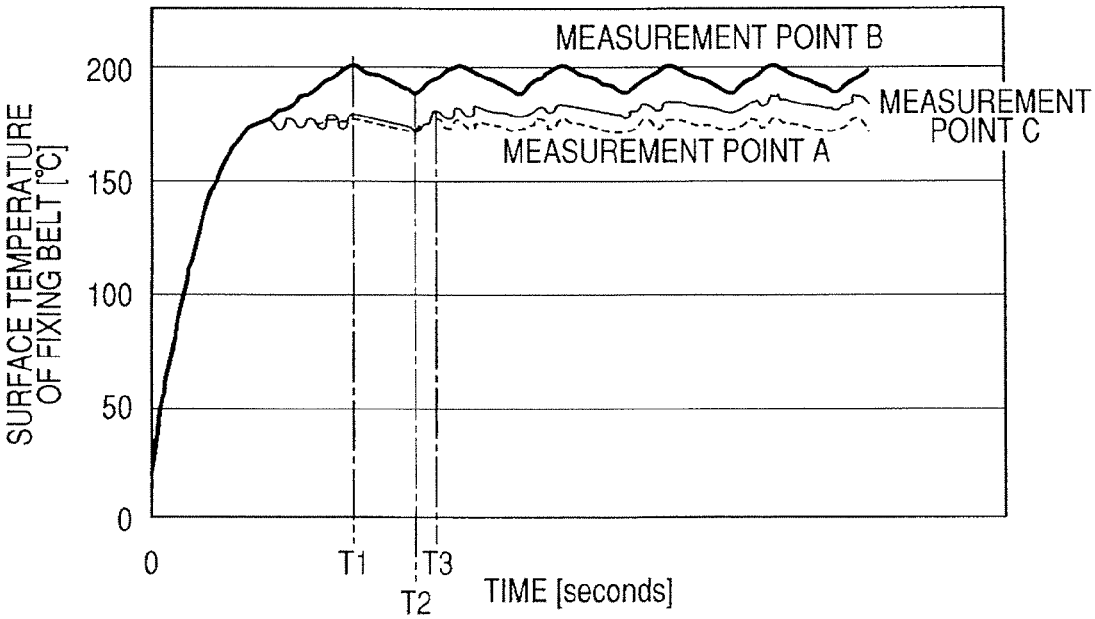
FIG. 26B is an explanatory diagram for explaining a temperature transition (No. 2).
Figure 26C:
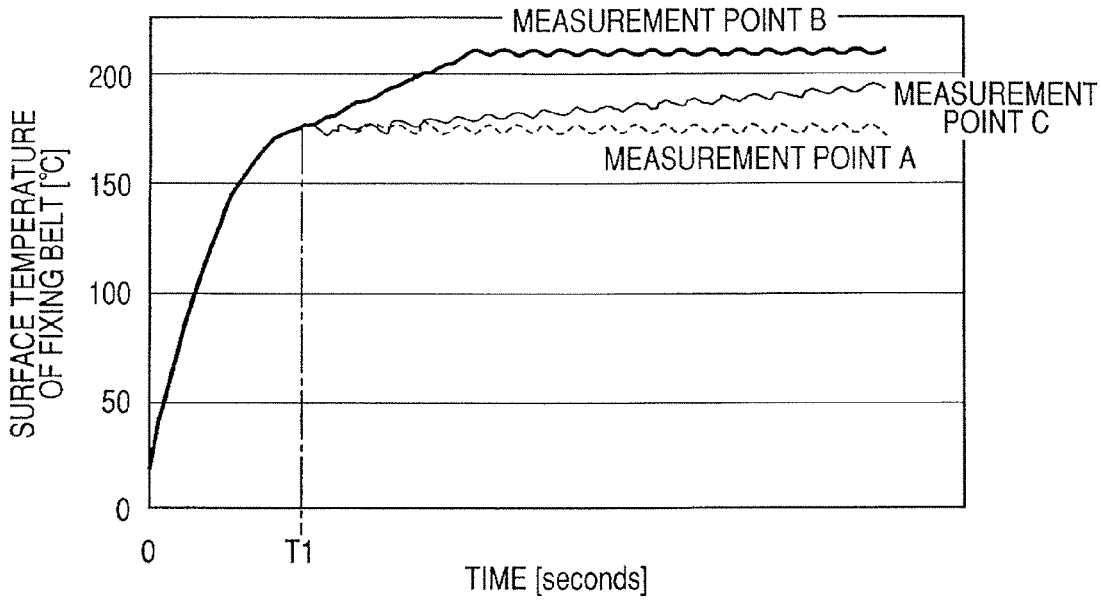
FIG. 26C is an explanatory diagram for explaining a temperature transition (No. 3).
Figure 27:
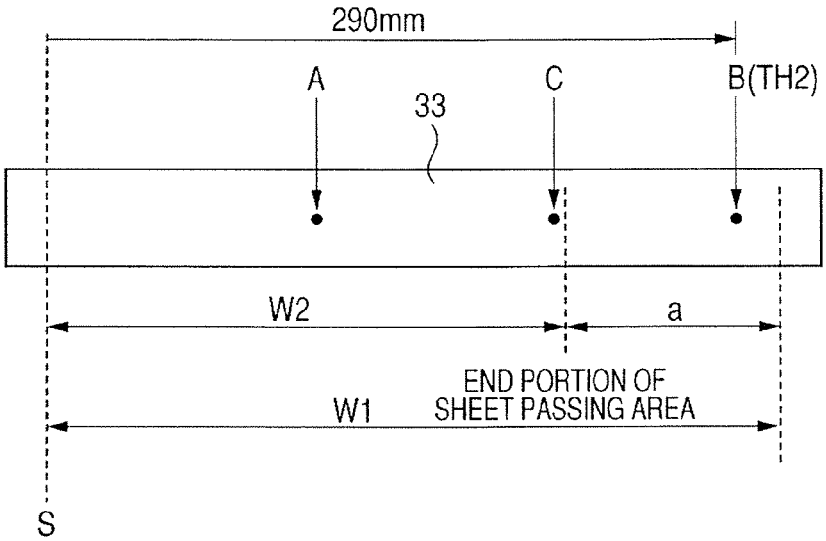
FIG. 27 is an explanatory diagram for explaining a temperature measuring position on a surface of the fixing belt.

Concrete temperature transitions are represented in FIG. 26A, FIG. 26B, and FIG. 26C.

A temperature transition in the case where a size of a small size width recording material in the width direction satisfies such a relationship "X−Y≦Y" is shown in FIG. 26A.

That is, a non-sheet passing area surface temperature indicated by symbol "B" is changed between 190 degrees and 200 degrees by an air blowing cooling operation, and an A4 portrait sheet passing area end portion denoted by symbol "C" never exceeds 190 degrees equal to an occurrence temperature of a hot offset. In other words, although the small-size-width recording material is continuously passed, there is no possibility that the hot offset occurs without lowering the productivity.

Next, a temperature transition in the case where a size of a small size width recording material in the width direction satisfies such a relationship "X−Y>Y" is shown in FIG. 26B.

When a detected temperature of the second temperature sensor shown by symbol "B" becomes 200 degrees (time T1), the throughput down control operation is carried out. In the third embodiment, while the sheet passing interval is widened, the energizing operation to the heater 35 is stopped for a time period other than the time period for passing the sheet so as to perform the heat dissipation cooling operation. At a predetermined time before the sheet passing operation is commenced, the heater 35 is again energized. In this case, in order to secure the fixability, after the detected temperature of the first temperature sensor TH1 reaches 220 degrees (time T3), namely after the belt surface temperature of the sheet passing area indicated by symbol "A" reaches 175 degrees, the recording material reaches the fixing area. As a result, the sheet passing operation is not carried out for a time period defined from the time T1 to the time T3, so the productivity is lowered. Such a long sheet passing interval is maintained until the continuous sheet passing operation of the postcards is ended, and there is no possibility that the sheet passing area end portion indicated by symbol C exceeds 190 degrees which correspond to the hot offset occurrence temperature. As a consequence, it is apparent that the hot offset never occurs.

It should be understood that those embodiments do not limit the present invention, but the fixing belt, the heating member, and the recording material sizes merely constitute one example. Furthermore, various sorts of temperatures, for instance, turn-ON/OFF temperatures of the air blowing fan 41 may be properly determined based on characteristics related to fixing apparatus and toners to be used, but are not limited only to those embodiments. In addition, although the fixing belt is cooled by the air blowing cooling mechanism portion in those embodiments, the cooling method is not limited only thereto. Alternatively, such an arrangement for cooling the pressure member, or cooling both the fixing member and the pressure member may be employed. For instance, in such a case where the pressure member corresponds to a belt member having a small heat capacity, while a further energy saving effect may be achieved, the inventive idea of the present invention may be applied.

As a consequence, although the image forming apparatus is equipped with the fixing belt type fixing apparatus with employment of the heating rotary member having the low heat capacity, while the image forming apparatus is not made bulky and complex unnecessarily, it is possible to prevent at the same time both lowering of the productivity and the occurrence of the hot offset when the small-size-width recording materials having the material sizes larger than, or equal to the predetermined size are passed in the continuous manner. As a result, such an image forming apparatus can be provided which can largely reduce the stresses of the user with respect to the productivity and the image qualities of the small-size-width recording materials, and the bulky and high cost aspects of the image forming apparatus.

While the image heating apparatus of the present invention are descried based on the above-mentioned embodiments, the image heating apparatus are not limited only to the above-mentioned arrangements, but may be alternatively realized by employing various types of arrangements in accordance with the proposals of the present invention.

Although the heating rotary member is the thin-walled roller type member having the low heat capacity in the above-mentioned embodiments, the present invention is not especially limited only to the roller type member. Thus, even when a belt type fixing member is employed, a similar effect may be achieved.

The image heating means 20A is not limited only to the film heating type heating apparatus of the embodiments, but may be alternatively realized as a heat roller type heating apparatus and heating apparatus having other different arrangements. Also, the mage heating means 20A may be realized by an electromagnetic induction heating type heating apparatus.

Also even when the image heating means 20A is realized by an image heating apparatus having such a structure that a recording material is passed at a center of the recording material, namely in the so-called "center transfer reference" manner, a similar effect may be achieved.

It should also be understood that as to widths of recording materials which are employed in image forming apparatus using electrophotographic systems, almost all of widths thereof are larger than, or equal to an A4 portrait width and an A5 landscape width (width direction size: 210 mm) in areas such as Japan where A-series recording materials and B-series recording materials are employed. In areas such as USA where L-series recording materials are employed, almost all of widths thereof are larger than, or equal to a letter portrait width and a legal landscape width (width direction size: 215.9 mm). However, there is a very rare case where image forming operations as to postcards (width direction size: 100 mm), and side-opening envelope type 4/com10 (width direction size: 105 mm) are required.

Figure 14A:
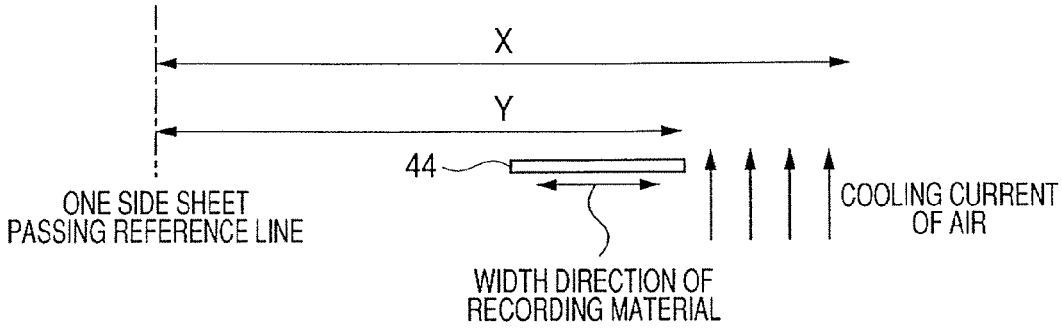
FIG. 14A, FIG. 14B, and FIG. 14C are explanatory diagrams for explaining a positional relationship between a length of a recording material in a width direction, and a shutter.
Figure 14B:
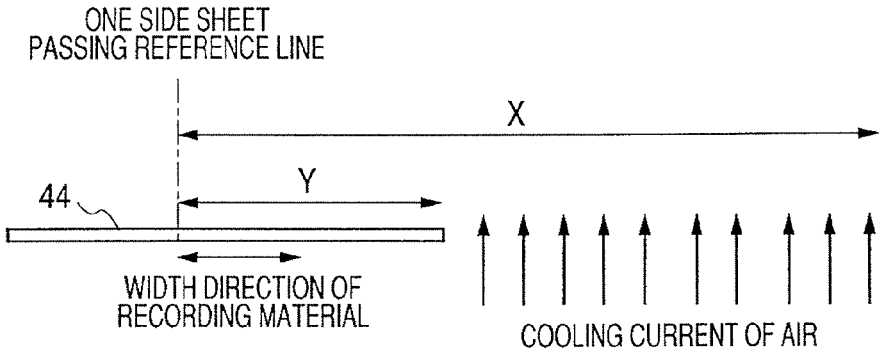
Figure 14C:
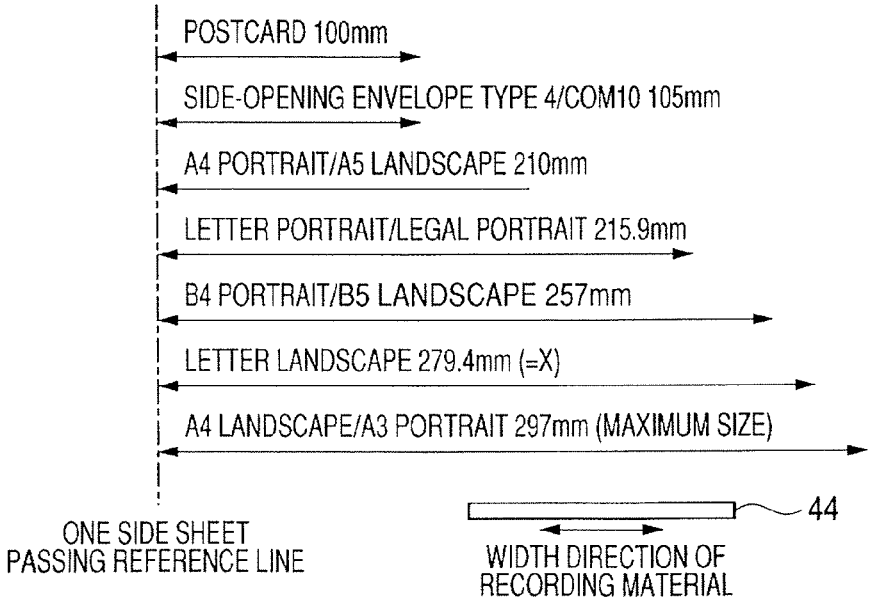

FIG. 14C is a diagram for indicating a positional relationship between various sorts of recording material sizes and the shutter member 44 in the fixing apparatus in which only the non-sheet passing area surface is cooled by the shutter member 44 which can be freely moved in the recording material width direction.

Similar to a general-purpose image forming apparatus, in the case where the maximum size width recording material corresponds to an A4 landscape size, a maximum size of a width direction among small-size-width recording materials is a letter landscape size (279.4 mm). Assuming now that the letter landscape size is defined as "X", and a size of a small-size-width recording material in a width direction which is passed is defined as "Y", the width of the shutter 44 requires at least a width of "X−Y." In this example, a description is made under such a condition that the width of the shutter 44 is equal to the minimum width of "X−Y."

Condition 1): In case of such a relationship "X−Y≦Y", the position of the shutter 44 becomes FIG. 14A, and there is no possibility that the shutter 44 is not projected to the outside from the fixing apparatus in the width direction.

Condition 2): In case of such a relationship "X−Y>Y", the position of the shutter 44 becomes FIG. 14B, and the shutter 44 is projected to the outside from the fixing apparatus in the width direction, so the width required by the fixing apparatus becomes wide.

As a means for capable of preventing the difficulty, for instance, the shutter member may be formed as a telescopically movable bellows shape. However, a shutter member having a bellows shape is expensive rather than a shutter member having a plate shape.

On the other hand, in such a case where although a size of a recording material in a width direction thereof becomes maximum among the small-size-width recording materials, a letter size landscape width is "X", such a size of a small-size-width recording material in the width direction capable of satisfying the relationship of "X−Y≦Y" becomes larger than, or equal to 139.7 mm. As a consequence, the small-size-width recording materials having the widths which are larger than, or equal to the above-mentioned A4 portrait width, A5 landscape width, letter portrait width, and legal portrait width are covered by the above-mentioned condition 1).

In other words, the non-sheet passing area surface is cooled by blowing the cooling air only in such a case where the small-size-width recording materials having the sizes of the width directions capable of satisfying the above-mentioned condition 1) are continuously passed in order to prevent both lowering of the productivity and the hot offset. This preventing idea may have a similar implication that lowering of the productivity and the hot offsets as to substantially all of recording materials employed in the image forming apparatus are prevented.

Also, in such a case where recording materials capable of satisfying the above-mentioned condition 2) as to a postcard and side-opening envelope type 4/com10 are continuously passed, if the detected temperature of the detecting means for detecting the temperature of the non-sheet passing area surface becomes higher than, or equal to the predetermined temperature, the throughput down control operation is carried out, which is similar to the control operation of the conventional image forming apparatus. The hot offset preventing operation is performed based on, for example, such a system that both the sheet supply operation is stopped and the heating operation of the heating member is stopped, and a self heat dissipation cooling operation is carried out until the detected temperature becomes lower than, or equal to the predetermined value, and thereafter, both the heating operation of the heating member and the paper supplying operation are restarted, namely, the hot offset is prevented based on the system for lowering the productivity. In this case, because there is a very rare case where the recording materials having these width direction sizes are employed, it is a very rare possibility that there is a only very small stress given to the user with respect to lowering of the productivity, which is not comparable with stresses of the user as to bulky and high cost aspects of the image forming apparatus.

As a consequence, also in the case of the fixing belt type fixing apparatus using the heating rotary member having the low heat capacity, while the fixing apparatus need not become bulky and complex unnecessarily, it is possible to avoid at the same time both lowering of the productivity and the occurrence of the hot offset when the small-size-width recording materials having the sizes larger than, or equal to the predetermined size are continuously passed. As a result, such an image forming apparatus can be provided which can largely reduce the stresses of the user with respect to the productivity and the image qualities of the small-size-width recording materials, and the bulky and high cost aspects of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and function.

This application claims the benefit of Japanese Patent Applications No. 2005-265871, filed Sep. 13, 2005, and No.

2005-265874, filed Sep. 13, 2005, which are hereby incorporated by reference herein in their entirety.

What is claimed is:

1. An image forming apparatus, comprising:

image forming means for forming a toner image on a recording material;

an image heating member, which heats the toner image formed on the recording material in a nip portion;

heating means for heating the image heating member;

first detecting means for detecting a temperature of a first area, which can be brought into contact with a recording material, of the image heating member, when a set width of the recording material is a predetermined width;

control means for controlling an electric power supply to the heating means in accordance with output of the first detecting means;

second detecting means for detecting a temperature of a second area outside of the first area of the image heating member in a width direction, when the set width of the recording material is the predetermined width;

cooling means for cooling the second area of the image heating member in accordance with output of the second detecting means;

third detecting means for detecting a temperature of a third area on an end side in the width direction within an area, which can be brought into contact with the recording material, of the image heating member, when the set width of the recording material is the predetermined width; and stopping means for stopping the image heating operation in accordance with output of the third detecting means.

2. An image forming apparatus according to claim 1, wherein the cooling means includes a cooling fan.

3. An image forming apparatus, comprising:

image forming means for forming a toner image on a recording material;

an image heating member, which heats the toner image formed on the recording material in a nip portion;

heating means for heating the image heating member;

first detecting means for detecting a temperature of a first area, which can be brought into contact with a recording material, of the image heating member, when a set width of the recording material is a predetermined width;

control means for controlling an electric power supply to the heating means in accordance with output of the first detecting means;

second detecting means for detecting a temperature of a second area outside of the first area of the image heating member in a width direction, when the set width of the recording material is the predetermined width;

cooling means for cooling the second area of the image heating member in accordance with output of the second detecting means;

third detecting means for detecting a temperature of a third area on an end side in the width direction within an area, which can be brought into contact with the recording material, of the image heating member, when the set width of the recording material is the predetermined width; and reducing means for reducing a number of recording materials, which pass through the nip portion per unit time in accordance with output of the third detecting means.

4. An image forming apparatus according to claim 1, wherein the cooling means includes a cooling fan.

5. An image forming apparatus, comprising:

image forming means for forming a toner image on a recording material;

an image heating member, which heats the toner image formed on the recording material in a nip portion;

detecting means for detecting a temperature of a first area outside of a second area, which can be brought into contact with the recording material, of the image heating member in a width direction, when a width of the recording material is a predetermined width;

cooling means for cooling the first area of the image heating member in accordance with output of the detecting means; and reducing means for reducing a number of recording materials, which pass through the nip portion per unit time, without performing the cooling operation of the cooling means, when the width of the recording materials is smaller than the predetermined width.

6. An image forming apparatus according to claim 5, wherein when the width of the recording material is smaller than the predetermined width, the reducing means increases a transport interval between recording materials to be transported to the nip portion, irrespective of the output of the detecting means.

7. An image forming apparatus according to claim 5, wherein when the width of the recording material is smaller than the predetermined width, the reducing means decreases a transport speed of the recording material transported by the image heating means, irrespective of the output of the detecting means.

* * * * *

UNITED STATES PATENT AND TRADEMARK OFFICE

CERTIFICATE OF CORRECTION

PATENT NO. : 7,421,219 B2
APPLICATION NO. : 11/470426
DATED : September 2, 2008
INVENTOR(S) : Matsuura et al.

It is certified that error appears in the above-identified patent and that said Letters Patent is hereby corrected as shown below:

COLUMN 1:
Line 18, “is” should read --are--.
Line 26, “ceramics” should read --ceramic--.
Line 33, “by” (second occurrence) should read --with--.
Line 34, “ceramics” should read --ceramic--.
Line 51, “system” should read --systems--.

COLUMN 3:
Line 61, “the” should be deleted.

COLUMN 6:
Line 25, “take” should read --taken--.
Line 61, “corresponds” should read --corresponding--.
Line 67, “communicate-ably” should read --communicably--.

COLUMN 7:
Line 37, “down stream-sided” should read --downstream-sided--.

COLUMN 8:
Line 8, “materials “p”” should read --materials “P”--.
Line 27, “secondary-transferred” should read --secondarily-transferred--.

COLUMN 9:
Line 37, “ceramics” should read --ceramic--.
Line 41, “ceramics” should read --ceramic--.
Line 42, “ceramics” should read --ceramic--.
Line 54, “silicone” should read --as silicone--.

COLUMN 10:
Line 21, “cylindrical-shape” should read --cylindrical-shaped--.

COLUMN 11:
Line 32, “indicate” should read --indicated--.

COLUMN 12:
Line 50, “are” should read --is--, and “correspond” should read --corresponds--.

COLUMN 14:
Line 29, “a” (first occurrence) should be deleted.

UNITED STATES PATENT AND TRADEMARK OFFICE

CERTIFICATE OF CORRECTION

PATENT NO. : 7,421,219 B2
APPLICATION NO. : 11/470426
DATED : September 2, 2008
INVENTOR(S) : Matsuura et al.

It is certified that error appears in the above-identified patent and that said Letters Patent is hereby corrected as shown below:

COLUMN 16:
Line 66, “paper erroneous” should read --erroneous paper--.

COLUMN 18:
Line 38, “by” should read --so--.

COLUMN 19:
Line 34, “communicate-ably” should read --communicably--.

COLUMN 20:
Line 2, “materials “p”” should read --materials “P”--.
Line 61, “secondary-transferred” should read --secondarily-transferred--.

COLUMN 21:
Line 30, “two-side” should read --two-sided--.

COLUMN 22:
Line 59, cylindrical-shape” should read --cylindrical-shaped--.

COLUMN 24:
Line 5, “indicate” should read --indicated--.

COLUMN 26:
Line 20, “a” (first occurrence) should be deleted.
Line 30, “correspond” should read --corresponds--.
Line 49, “port” should read --ports--.
Line 54, “is” should read --are--.

COLUMN 28:
Line 23, “prevent” should read --preventing--.
Line 58, “width” should read --widths--.

COLUMN 29:
Line 11, “width” should read --widths--.

COLUMN 30:
Line 31, “correspond” should read --corresponds--.
Line 66, “descried” should read --described--.

UNITED STATES PATENT AND TRADEMARK OFFICE

CERTIFICATE OF CORRECTION

PATENT NO. : 7,421,219 B2
APPLICATION NO. : 11/470426
DATED : September 2, 2008
INVENTOR(S) : Matsuura et al.

It is certified that error appears in the above-identified patent and that said Letters Patent is hereby corrected as shown below:

COLUMN 31:
Line 14, “mage” should read --image--.
Line 63, “for” should be deleted.

COLUMN 32:
Line 64, “function.” should read --functions.--.

Signed and Sealed this

Twenty-seventh Day of January, 2009

JOHN DOLL
*Acting Director of the United States Patent and Trademark Office*